US010704788B2

(12) United States Patent
Thibodeau-Fortin

(10) Patent No.: US 10,704,788 B2
(45) Date of Patent: Jul. 7, 2020

(54) SOLID FUEL BURNING APPLIANCE HAVING AN AIR INTAKE CONTROL ASSEMBLY AND METHOD FOR CONTROLLING AN AIR INTAKE INTO A COMBUSTION CHAMBER OF A SOLID FUEL BURNING APPLIANCE

(71) Applicant: FABRICANT DE POÊLES INTERNATIONAL INC., St-Augustin-de-Desmaures (Québec) (CA)

(72) Inventor: Guillaume Thibodeau-Fortin, Québec (CA)

(73) Assignee: FABRICANT DE POÊLES INTERNATIONAL INC., Saint-Augustin-de Desmaures (CA)

( * ) Notice: Subject to any disclaimer, the term of this patent is extended or adjusted under 35 U.S.C. 154(b) by 219 days.

(21) Appl. No.: 15/679,809

(22) Filed: Aug. 17, 2017

(65) Prior Publication Data

US 2018/0051885 A1 Feb. 22, 2018

Related U.S. Application Data

(60) Provisional application No. 62/376,066, filed on Aug. 17, 2016, provisional application No. 62/512,360, filed on May 30, 2017.

(51) Int. Cl.
*F24B 1/187* (2006.01)
*F24B 5/02* (2006.01)
(Continued)

(52) U.S. Cl.
CPC ..... *F24B 1/187* (2013.01); *F23L 13/04* (2013.01); *F23L 13/10* (2013.01); *F23N 3/045* (2013.01); *F24B 1/19* (2013.01); *F24B 5/026* (2013.01)

(58) Field of Classification Search
CPC ..... F24B 1/19; F24B 1/187
(Continued)

(56) References Cited

U.S. PATENT DOCUMENTS 3,882,767 A * 5/1975 Oyler ..... A21B 1/24 99/339
4,427,292 A * 1/1984 Buchanan ..... G03B 27/465 355/54
(Continued)

*Primary Examiner* — Grant Moubry
*Assistant Examiner* — Aaron H Heyamoto
(74) *Attorney, Agent, or Firm* — Marshall, Gerstein & Borun LLP

(57) ABSTRACT

An air intake control assembly for adjusting an air intake into a combustion chamber of a solid fuel burning appliance is provided. The air intake control assembly comprises a mounting structure having at least one air intake opening, a shutter mounted to the mounting structure and configurable between an open configuration and an at least partially closed configuration, a power supply, a motor operatively connected to the shutter and activable to modify a configuration of the shutter with respect to the at least one air intake opening, a temperature sensor electrically connected to the motor and the power supply to monitor a temperature representative of a temperature of the combustion chamber; and an electric circuit connecting the motor to the power supply and being operatively connected the temperature sensor. A solid fuel burning appliance and a method for controlling an air intake into a combustion chamber of a solid fuel burning appliance are also provided.

24 Claims, 13 Drawing Sheets

(51) Int. Cl.

| | |
|---|---|
| ***F23N 3/04*** | (2006.01) |
| ***F23L 13/04*** | (2006.01) |
| ***F23L 13/10*** | (2006.01) |
| ***F24B 1/19*** | (2006.01) |

(58) Field of Classification Search
USPC ..... 126/502
See application file for complete search history.

(56) References Cited

U.S. PATENT DOCUMENTS

| | | | | |
|---|---|---|---|---|
| 4,574,772 | A * | 3/1986 | Nagel | F24B 1/192 126/518 |
| 5,555,876 | A * | 9/1996 | Francisco, Jr. | A62C 4/04 126/504 |
| 7,275,533 | B2 * | 10/2007 | Soeholm | F23N 3/002 126/299 R |
| 2017/0276345 | A1 * | 9/2017 | Shimazu | F23D 14/06 |

* cited by examiner

SOLID FUEL BURNING APPLIANCE HAVING AN AIR INTAKE CONTROL ASSEMBLY AND METHOD FOR CONTROLLING AN AIR INTAKE INTO A COMBUSTION CHAMBER OF A SOLID FUEL BURNING APPLIANCE

CROSS-REFERENCE TO RELATED APPLICATIONS

This is the non-provisional under 35 USC § 119(e) and claims the benefit of the filing date of US Provisional Application Nos. 62/376,066, filed Aug. 17, 2016, and 62/512,360, filed May 30, 2017. The entire disclosures of U.S. Provisional Application Nos. 62/376,066 and 62/512,360 are hereby incorporated by reference.

TECHNICAL FIELD

The technical field generally relates to solid fuel burning appliances including and without being limitative fireplaces, stoves, fireplace inserts, and furnaces. More particularly, the technical field relates to an air intake control assembly for controlling an air intake into a combustion chamber of a solid fuel burning appliance. It also relates to a method for controlling an air intake into a combustion chamber of a solid fuel burning appliance.

BACKGROUND

Solid fuel burning appliances such as high efficiency appliances have been increasingly used for heating homes. They can provide an alternative to other heating systems and can also provide a visually attractive option to heat a home. A balance between effective heating and combustion efficiency is an important feature to take into consideration when designing such solid fuel burning appliances. This involves controlling the air intake into the combustion chamber to increase the combustion efficiency while trying to reduce the production of combustion by-products such as soot and creosote. Production of soot and creosote is an undesirable factor that can affect the efficiency of the burning appliance, for instance when such by-products accumulate in the flue and/or within the burning appliance itself. In addition, accumulation of soot on an interior surface of the glass door of the burning appliance is not esthetically pleasing and is to be avoided.

Various challenges exist for improving the control of the air intake in a combustion chamber of a solid fuel burning appliance, in particular with regard to the volume of air being allowed to enter the combustion chamber depending of the desired combustion regimen and the location of the air intake within the combustion chamber.

In view of the above, there is a need for a solid fuel burning appliance that overcomes at least some of the above-mentioned prior art concerns.

SUMMARY

In accordance with an aspect, there is provided an air intake control assembly for adjusting an air intake into a combustion chamber of a solid fuel burning appliance, such as a solid fuel burning stove, having an appliance air inlet. The air intake control assembly comprises a mounting structure having at least one air intake opening defining an air path between the appliance air intake port and the combustion chamber; a shutter mounted to the mounting structure and configurable between an open configuration and an at least partially closed configuration wherein a section of the shutter at least partially covers the at least one air intake opening; a power supply; a motor operatively connected to the shutter to configure same when actuated to at least partially cover the at least one air intake opening; a temperature limit switch electrically connected to the motor and the power supply and monitoring a temperature in proximity of the combustion chamber and being configurable in an open configuration allowing electric current passage therethrough and a closed configuration preventing electric current passage therethrough; and an electric circuit connecting the motor to the power supply through the temperature limit switch wherein the electric circuit is in an open configuration when at least one of the shutter and the temperature limit switch is in the open configuration to prevent electric current to reach the motor and is in a closed configuration otherwise.

In an embodiment, the air intake control assembly further comprises a shutter limit switch configured to detect at least one position of the shutter and electrically connecting the motor to the power supply through the electric circuit, the shutter limit switch being configurable in an open configuration upon detection of the at least one position of the shutter and preventing electric current therethrough and to reach the motor, and being configurable in a closed configuration otherwise allowing electric current passage therethrough.

In an embodiment, the shutter limit switch is positioned to physically contact the shutter when the shutter is in the open configuration and the shutter limit switch being configurable in the open configuration upon physical contact between the shutter limit switch and the shutter and preventing electric current therethrough and to reach the motor, and being configurable in the closed configuration upon absence of physical contact between the shutter limit switch and the shutter allowing electric current passage therethrough.

In an embodiment, the shutter comprises a primary pivotable arm and a secondary pivotable arm and the primary pivotable arm is pivotable between a first open configuration and a first at least partially closed configuration and the secondary pivotable arm is pivotable between a second open configuration and a second at least partially closed configuration, wherein the shutter limit switch detects the at least one position of the primary pivotable arm and the at least one position comprises the first open configuration and the motor is operatively connected to the secondary pivotable arm and configures same from the second open configuration to the second at least partially closed configuration upon actuation thereof.

In an embodiment, the primary pivotable arm and the secondary pivotable arm are cooperatively engaged with each other through an interconnecting flange.

In an embodiment, the shutter limit switch comprises a primary shutter limit switch and a secondary shutter limit switch, the primary shutter limit switch being positioned to physically contact the primary pivoting arm when the primary pivoting arm is in the open configuration and the secondary shutter limit switch being positioned to physically contact the secondary pivoting arm when the secondary pivoting arm is in the closed configuration.

In accordance with another aspect, there is provided a solid fuel burning appliance, such as a solid fuel burning stove. The solid fuel burning appliance comprises an appliance housing having an appliance air inlet defined therein; a combustion chamber housing at least partially surrounded by the appliance housing and defining a combustion chamber and having a combustion chamber air inlet defined therein; a combustion air channel extending between the appliance air inlet and the air inlet of the combustion chamber and providing fluid communication inbetween; and an air intake control assembly. The air intake control assembly comprises a mounting structure mounted to at least one of the appliance housing and the combustion chamber housing and having at least one air intake opening extending in the combustion air channel; a shutter mounted to the mounting structure and configurable between an open configuration and an at least partially closed configuration wherein a section of the shutter at least partially cover the at least one air intake opening; a power supply; a motor operatively connected to the pivotable arm; a temperature limit switch electrically connected to the motor and the power supply and monitoring a temperature in proximity of the combustion chamber and being configurable in a closed configuration allowing electric current passage therethrough and an open configuration preventing electric current passage therethrough; and an electric circuit connecting the motor to the power supply through the temperature limit switch wherein the electric circuit is in an open configuration in at least one of the open configuration of the pivotable arm and the open configuration of the temperature limit switch to prevent electric current to reach the motor and is in a closed configuration otherwise.

In accordance with another aspect, there is provided a method for controlling an air intake into a combustion chamber of a solid fuel burning appliance, such as a solid fuel burning stove, using an air intake control assembly having a shutter configurable with respect to at least one air intake opening extending in an air combustion channel defined between an appliance air inlet and an air inlet of the combustion chamber. The method comprises the steps of:

detecting a position of the shutter with respect to the at least one air intake opening;

monitoring a temperature in proximity to the combustion chamber;

comparing monitored temperature to a temperature threshold; and if the monitored temperature is equal to or above the temperature threshold and the detected position of the shutter is in at least one predetermined configuration, further closing the at least one air intake opening by displacing the shutter with respect to the at least one air intake opening.

In an embodiment, the method further comprises the steps of configuring the shutter in an open configuration and igniting a fire into the combustion chamber and wherein the at least one predetermined configuration of the shutter is a non-open configuration.

In an embodiment, the air intake control assembly further comprises a power supply, a motor operatively connected to the shutter to modify a configuration thereof, and an electric circuit electrically connecting the power supply and the motor together, wherein further closing the at least one air intake opening comprises: closing the electric circuit to allow electric current passage between the power supply and the motor if the monitored temperature is equal to or above the temperature threshold and the detected position of the shutter is in the at least one predetermined configuration; otherwise, opening the electric circuit.

In an embodiment, further closing the at least one air intake opening comprises: pivoting the shutter in a closed configuration.

In accordance with another aspect, there is provided a method for controlling an air intake into a combustion chamber of a solid fuel burning appliance, such as a solid fuel burning stove, using an air intake control assembly having a shutter configurable with respect to at least one air intake opening extending in an air combustion channel defined between an appliance air inlet and an air inlet of the combustion chamber. The method comprises the steps of monitoring a temperature in proximity to the combustion chamber; comparing monitored temperature to a temperature threshold; if the monitored temperature is equal to or above the temperature threshold, closing the at least one air intake opening by displacing the shutter by at least one closing incremental step with respect to the at least one air intake opening; and if the monitored temperature is below the temperature threshold, opening the at least one air intake opening by displacing the shutter by at least one opening incremental step with respect to the at least one air intake opening.

In accordance with another aspect, there is provided an air intake control assembly for adjusting an air intake into a combustion chamber of a solid fuel burning appliance, such as a solid fuel burning stove, having an appliance air inlet. The air intake control assembly comprises a mounting structure having at least one air intake opening defining an air path between the appliance air inlet and the combustion chamber; a shutter mounted to the mounting structure and configurable to adopt a plurality of configurations with respect to the at least one air intake opening, wherein the plurality of configurations comprises at least an open configuration and a closed configuration wherein a section of the shutter at least partially covers the at least one air intake opening; a motor operatively connected to the shutter to configure same when actuated; a controller operatively connected to the motor; and a temperature sensor operatively connected to the controller and monitoring a temperature in proximity of the combustion chamber; wherein the motor configures the shutter in at least one of the plurality of configurations based on the temperature monitored by the temperature sensor.

In accordance with another aspect, there is provided a solid fuel burning appliance, such as a solid fuel burning stove. The solid fuel burning appliance comprises an appliance housing having an appliance air inlet defined therein; a combustion chamber housing at least partially surrounded by the appliance housing and defining a combustion chamber and having a combustion chamber air inlet defined therein; a combustion air channel extending between the appliance air inlet and the combustion chamber air inlet and providing fluid communication inbetween; an air intake control assembly comprising a mounting structure mounted to at least one of the appliance housing and the combustion chamber housing and having at least one air intake opening extending in the combustion air channel; a shutter mounted to the mounting structure and configurable to adopt a plurality of configurations with respect to the at least one air intake opening, wherein the plurality of configurations comprises at least an open configuration and a closed configuration wherein a section of the shutter at least partially covers the at least one air intake opening; a motor operatively connected to the shutter to configure same when actuated; a controller operatively connected to the motor; and a temperature sensor operatively connected to the controller and monitoring a temperature in proximity of the combustion chamber; wherein the motor configures the shutter in at least one of the plurality of configurations based on the temperature monitored by the temperature sensor.

According to a general aspect there is provided a solid fuel burning appliance comprising:

an appliance housing having an appliance air inlet defined therein;

a combustion chamber housing at least partially surrounded by the appliance housing and defining a combustion chamber and having at least one combustion chamber air inlet defined therein;

a combustion air path extending between the appliance air inlet and a respective one of the at least one combustion chamber air inlet and providing fluid communication inbetween;

an air intake control assembly.

The air intake control assembly comprises:

a mounting structure mounted to at least one of the appliance housing and the combustion chamber housing and having at least one air intake opening extending in the combustion air path;

a shutter mounted to the mounting structure and configurable between an open configuration and a closed configuration in which the shutter at least partially covers the at least one air intake opening;

a power supply;

a motor operatively connected to the shutter and activable to modify a configuration of the shutter with respect to the at least one air intake opening and thereby modify a covering of the at least one air intake opening by the shutter;

a temperature limit switch electrically connected to the motor and monitoring a temperature representative of a temperature of the combustion chamber and being configurable in a closed configuration allowing electric current passage therethrough and an open configuration preventing electric current passage therethrough; and an electric circuit connecting the motor to the power supply through the temperature limit switch wherein the electric circuit is in an open configuration when at least one of the shutter and the temperature limit switch is in the open configuration to prevent electric current to reach the motor.

In an embodiment, the temperature limit switch is in the open configuration if the monitored temperature is below a combustion control temperature threshold and is in the closed configuration otherwise.

In an embodiment, the solid fuel burning appliance further comprises a shutter limit switch configured to sense at least one configuration of the shutter, the shutter limit switch being configurable in an open configuration upon sensing of the shutter configured in the at least one configuration and preventing electric current therethrough and to reach the motor, and being configurable in a closed configuration otherwise allowing electric current passage therethrough. The shutter limit switch can be positioned to physically contact the shutter when the shutter is in the open configuration and the shutter limit switch can be configurable in the open configuration upon physical contact between the shutter limit switch and the shutter and preventing electric current therethrough and to reach the motor, and being configurable in the closed configuration upon absence of physical contact between the shutter limit switch and the shutter allowing electric current passage therethrough.

In an embodiment, the shutter is at least one of pivotally mounted and translatably mounted to the mounting structure and configurable between the open configuration and the closed configuration.

In an embodiment, the shutter comprises a primary pivotable arm and a secondary pivotable arm and the primary pivotable arm is pivotable between a first open configuration and a first closed configuration and the secondary pivotable arm is pivotable between a second open configuration and a second closed configuration, wherein the shutter limit switch senses at least one configuration of the primary pivotable arm and the at least one configuration comprises the first open configuration and the motor is operatively connected to the secondary pivotable arm and configures same into the second closed configuration upon actuation thereof. The primary pivotable arm and the secondary pivotable arm can be cooperatively engaged with each other through an interconnecting flange and configuration of the primary pivotable arm into the first open configuration can configure the secondary pivotable arm into the second open configuration. In an embodiment, at least one of the primary pivotable arm and the secondary pivotable arm comprises a pivotable arm opening defined therein and an auxiliary shutter superposed thereto with an auxiliary air intake opening defined therein, wherein the auxiliary shutter is configurable in an open configuration wherein the pivotable arm opening and the auxiliary air intake opening are in register, and in an at least partially closed configuration otherwise. The auxiliary shutter can be translatable relative to the at least one of the primary pivotable arm and the secondary pivotable arm, to translate between the open configuration and the at least partially closed configuration.

In an embodiment, the shutter limit switch comprises a primary shutter limit switch and a secondary shutter limit switch, the primary shutter limit switch being positioned to physically contact the primary pivoting arm when the primary pivoting arm is in the open configuration and the secondary shutter limit switch being positioned to physically contact the secondary pivoting arm when the secondary pivoting arm is in the closed configuration. The primary shutter limit switch and the secondary shutter limit switch can be mounted in series, both the primary shutter limit switch and the secondary shutter limit switch being required to be in the closed configuration to allow electric current to pass therethrough.

In an embodiment, the solid fuel burning appliance further comprises a chimney in gas communication with the combustion chamber and the air intake control assembly further comprises a pressure limit switch monitoring a pressure representative of a pressure inside the chimney, the pressure limit switch electrically connecting the motor to the power supply through the electric circuit, the pressure limit switch being configurable in a closed configuration allowing electric current passage therethrough and an open configuration preventing electric current passage therethrough, the pressure limit switch being configurable in the closed configuration when the pressure monitored in the chimney is equal to or above a pressure threshold In an embodiment, air can flow through the at least one air intake opening in the closed configuration.

In an embodiment, the appliance air inlet defined in the appliance housing and the at least one air intake opening of the air intake control assembly together define a first portion of the combustion air path and the at least one air intake opening of the air intake control assembly and the at least one combustion chamber air inlet together define a second portion of the combustion air path. The solid fuel burning appliance can further comprise at least one combustion air duct defining the second portion of the combustion air path, the at least one combustion air duct being secured to the mounting structure of the air intake control assembly and each one of the at least one combustion air duct surrounding a respective one of the at least one air intake opening at one end, and being secured to the combustion chamber air inlet and surrounding a respective one of the at least one combustion chamber air inlet at an opposed end. The at least one combustion chamber air inlet can comprise a primary combustion chamber air inlet and a secondary combustion chamber air inlet. The at least one air intake opening of the air intake control assembly can include a primary air opening and a secondary air opening. The at least one combustion air duct can comprise a primary combustion air duct extending between the primary air opening and the primary combustion air inlet and a secondary combustion air duct extending between the secondary air opening and the secondary combustion air inlet. The primary combustion chamber air inlet can be provided in a top wall of the combustion chamber housing, and the secondary combustion chamber air inlet can be provided in a lower section of the combustion chamber housing.

According to another general aspect, there is provided an air intake control assembly for adjusting an air intake into a combustion chamber of a solid fuel burning appliance having an appliance air inlet. The air intake control assembly comprises:

- a mounting structure having at least one air intake opening extending in a combustion air path defined between the appliance air inlet and the combustion chamber;
- a shutter mounted to the mounting structure and configurable between an open configuration and a closed configuration in which the shutter at least partially covers the at least one air intake opening;
- a power supply;
- a motor operatively connected to the shutter and activable to modify a configuration of the shutter with respect to the at least one air intake opening and thereby modify a covering of the at least one air intake opening by the shutter;
- a temperature sensor operatively connected to the motor and monitoring a temperature representative of a temperature of the combustion chamber; and
- an electric circuit electrically connecting the motor, the power supply and the shutter and being operatively connected the temperature sensor, wherein the electric circuit is in an open configuration when at least one of the shutter is in the open configuration and the temperature monitored by the temperature sensor is below a combustion control temperature threshold to prevent electric current to reach the motor.

In an embodiment, the temperature sensor comprises a temperature limit switch configurable in a closed configuration allowing electric current passage therethrough and an open configuration preventing electric current passage therethrough, the temperature limit switch being configured in the closed configuration when the temperature monitored by the temperature sensor is equal to or above the combustion control temperature threshold. The electric circuit can connect the motor to the power supply through the temperature limit switch. The intake control assembly can further comprise a shutter limit switch configured to sense at least one configuration of the shutter and electrically connecting the motor to the power supply through the electric circuit. The shutter limit switch can be configurable in an open configuration upon sensing of the shutter configured in the at least one configuration and preventing electric current therethrough and to reach the motor, and can be configurable in a closed configuration otherwise allowing electric current passage therethrough. In an embodiment, the shutter limit switch is positioned to physically contact the shutter when the shutter is in the open configuration, the shutter limit switch being configurable in the open configuration upon physical contact between the shutter limit switch and the shutter and preventing electric current therethrough and to reach the motor, and being configurable in the closed configuration upon absence of physical contact between the shutter limit switch and the shutter allowing electric current passage therethrough.

In an embodiment, the shutter is at least one of pivotally mounted and translatably mounted to the mounting structure and configurable between the open configuration and the closed configuration.

In an embodiment, the shutter comprises a primary pivotable arm and a secondary pivotable arm and the primary pivotable arm is pivotable between a first open configuration and a first closed configuration and the secondary pivotable arm is pivotable between a second open configuration and a second closed configuration, wherein the shutter limit switch senses at least one configuration of the primary pivotable arm and the at least one configuration comprises the first open configuration and the motor is operatively connected to the secondary pivotable arm and configures same into the second at closed configuration upon actuation thereof. The primary pivotable arm and the secondary pivotable arm can be cooperatively engaged with each other through an interconnecting flange and configuration of the primary pivotable arm into the first open configuration can configure the secondary pivotable arm into the second open configuration. The primary pivotable arm and the secondary pivotable arm can be pivotable about a respective pivot axis. The primary pivotable arm and the secondary pivotable arm can be pivotable about a same pivot axis and are superposed relative to one another.

In an embodiment, at least one of the primary pivotable arm and the secondary pivotable arm comprises a pivotable arm opening defined therein and an auxiliary shutter superposed thereto with an auxiliary air intake opening defined therein, wherein the auxiliary shutter is configurable in an open configuration wherein the pivotable arm opening and the auxiliary air intake opening are in register, and in an at least partially closed configuration otherwise. The auxiliary shutter can be translatable relative to the at least one of the primary pivotable arm and the secondary pivotable arm, to translate between the open configuration and the at least partially closed configuration.

In an embodiment, the shutter limit switch comprises a primary shutter limit switch and a secondary shutter limit switch, the primary shutter limit switch being positioned to physically contact the primary pivoting arm when the primary pivoting arm is in the open configuration and the secondary shutter limit switch being positioned to physically contact the secondary pivoting arm when the secondary pivoting arm is in the closed configuration. The primary shutter limit switch and the secondary shutter limit switch can be mounted in series, both the primary shutter limit switch and the secondary shutter limit switch being required to be in the closed configuration to allow electric current to pass therethrough.

In an embodiment, the air intake control assembly further comprises a pressure limit switch monitoring a pressure representative of a pressure inside a chimney of the solid fuel burning appliance, the pressure limit switch electrically connecting the motor to the power supply through the electric circuit, the pressure limit switch being configurable in a closed configuration allowing electric current passage therethrough and an open configuration preventing electric current passage therethrough, the pressure limit switch being configurable in the closed configuration when the pressure monitored in the chimney is equal to or above a pressure threshold.

In an embodiment, the air intake control assembly further comprises a controller operatively connected to the motor and to the temperature sensor, the controller driving the motor based on the temperature monitored by the temperature sensor.

In an embodiment, air can flow through the at least one air intake opening in the closed configuration.

According to still another general aspect, there is provided a solid fuel burning appliance comprising:

an appliance housing having the appliance air inlet defined therein;

a combustion chamber housing at least partially surrounded by the appliance housing and defining the combustion chamber and having a combustion chamber air inlet defined therein;

the combustion air path extending between the appliance air inlet and the combustion chamber air inlet and providing fluid communication inbetween; and the air intake control assembly as described above.

According to further general aspect, there is provided a method for controlling an air intake into a combustion chamber of a solid fuel burning appliance using an air intake control assembly having a shutter configurable with respect to at least one air intake opening extending in an combustion air path defined between an appliance air inlet and a combustion chamber air inlet. The method comprising:

sensing a configuration of the shutter with respect to the at least one air intake opening;

monitoring a temperature representative of a temperature of the combustion chamber;

comparing monitored temperature to a combustion control temperature threshold; and if the monitored temperature is equal to or above the temperature threshold and the sensed configuration of the shutter is in at least one predetermined configuration, further closing the at least one air intake opening by displacing the shutter with respect to the at least one air intake opening.

In an embodiment, the method further comprises configuring the shutter in an open configuration and igniting a fire in the combustion chamber and wherein the at least one predetermined configuration of the shutter comprises a non-open configuration. In an embodiment, configuring the shutter in the open configuration comprises configuring the shutter such that there is a physical contact between the shutter and a shutter limit switch.

In an embodiment, the at least one predetermined configuration is a configuration wherein the configuration of the shutter is not sensed.

In an embodiment, further closing the at least one air intake opening comprises pivoting the shutter towards a closed configuration. In an embodiment, pivoting the shutter towards the closed configuration comprises rotating the motor to apply a force on a lever operatively connected to the shutter to pivot same until the closed configuration is reached.

According another general aspect, there is provided a method for controlling an air intake into a combustion chamber of a solid fuel burning appliance using an air intake control assembly having a shutter configurable with respect to at least one air intake opening extending in an air combustion path defined between an appliance air inlet and an air inlet of the combustion chamber. The method comprises:

monitoring a temperature representative of a temperature of the combustion chamber;

comparing the monitored temperature to a combustion mode temperature threshold;

if the monitored temperature is equal to or above the temperature threshold, closing the at least one air intake opening by displacing the shutter by at least one closing incremental step with respect to the at least one air intake opening; and if the monitored temperature is below the temperature threshold, opening the at least one air intake opening by displacing the shutter by at least one opening incremental step with respect to the at least one air intake opening.

In an embodiment, the method further comprises sensing a configuration of the shutter with respect to the at least one air intake opening and preventing displacement of the shutter by the at least one incremental opening step if the shutter is in the open configuration and by the at least one incremental closing step if the shutter is in the closed configuration.

In an embodiment, the method further comprises comparing the monitored temperature to a combustion control temperature threshold and preventing displacement of the shutter by the at least one incremental opening step if the monitored temperature is below the combustion control temperature threshold.

In an embodiment, the method further comprises comparing the monitored temperature to a maximal temperature threshold and configuring the shutter in the closed configuration if the monitored temperature is equal to or above the maximal temperature threshold.

According another general aspect, there is provided an air intake control assembly for adjusting an air intake into a combustion chamber of a solid fuel burning appliance having an appliance air inlet. The air intake control assembly comprises:

a mounting structure having at least one air intake opening extending in a combustion air path defined between the appliance air inlet and the combustion chamber;

a shutter mounted to the mounting structure and configurable to adopt a plurality of configurations with respect to the at least one air intake opening, wherein the plurality of configurations comprises at least an open configuration and a closed configuration in which the shutter at least partially covers the at least one air intake opening;

a motor operatively connected to the shutter and activable to modify a configuration of the shutter with respect to the at least one air intake opening and thereby modify a covering of the at least one air intake opening by the shutter;

a controller operatively connected to the motor; and a temperature sensor monitoring a temperature representative of a temperature of the combustion chamber and being operatively connected to the controller;

wherein, based on information provided by the temperature sensor through the controller, the motor configures the shutter in at least one of the plurality of configurations.

In an embodiment, the mounting structure comprises a stopping pin and the shutter comprises an open configuration limit stop and a closed configuration limit stop, wherein, in the open configuration of the shutter, the open configuration limit stop abuts against the stopping pin and, in the closed configuration of the shutter, the closed configuration limit stop abuts against the stopping pin.

In an embodiment, the shutter is pivotally mounted to the mounting structure and pivots between the open configuration and the closed configuration with respect to the at least one air opening.

In an embodiment, the motor comprises a stepper motor comprising a motor shaft operatively connected with the shutter to engage the shutter in a clockwise rotation or a counterclockwise rotation and allow the shutter to rotate incrementally to adopt the plurality of configurations.

In an embodiment, the air intake control assembly further comprises an electric circuit connecting the motor to a power supply, to the stopping pin, and to the controller, the controller being configured to drive the motor based on the temperature monitored by the temperature sensor and a configuration of the shutter monitored by the stopping pin.

In an embodiment, the air intake control assembly further comprises a pressure sensor monitoring a pressure representative of a pressure inside a chimney of the solid fuel burning appliance, the pressure sensor being operatively connected to the controller.

In an embodiment, the temperature sensor comprises at least one of a resistance temperature detector, a thermocouple and a thermistor.

According to still another general aspect, there is provided a solid fuel burning appliance comprising:

- an appliance housing having the appliance air inlet defined therein;
- a combustion chamber housing at least partially surrounded by the appliance housing and defining the combustion chamber and having a combustion chamber air inlet defined therein;
- the combustion air path extending between the appliance air inlet and the combustion chamber air inlet and providing fluid communication inbetween; and
- the air intake control assembly as described above.

DETAILED DESCRIPTION

Figure 1:
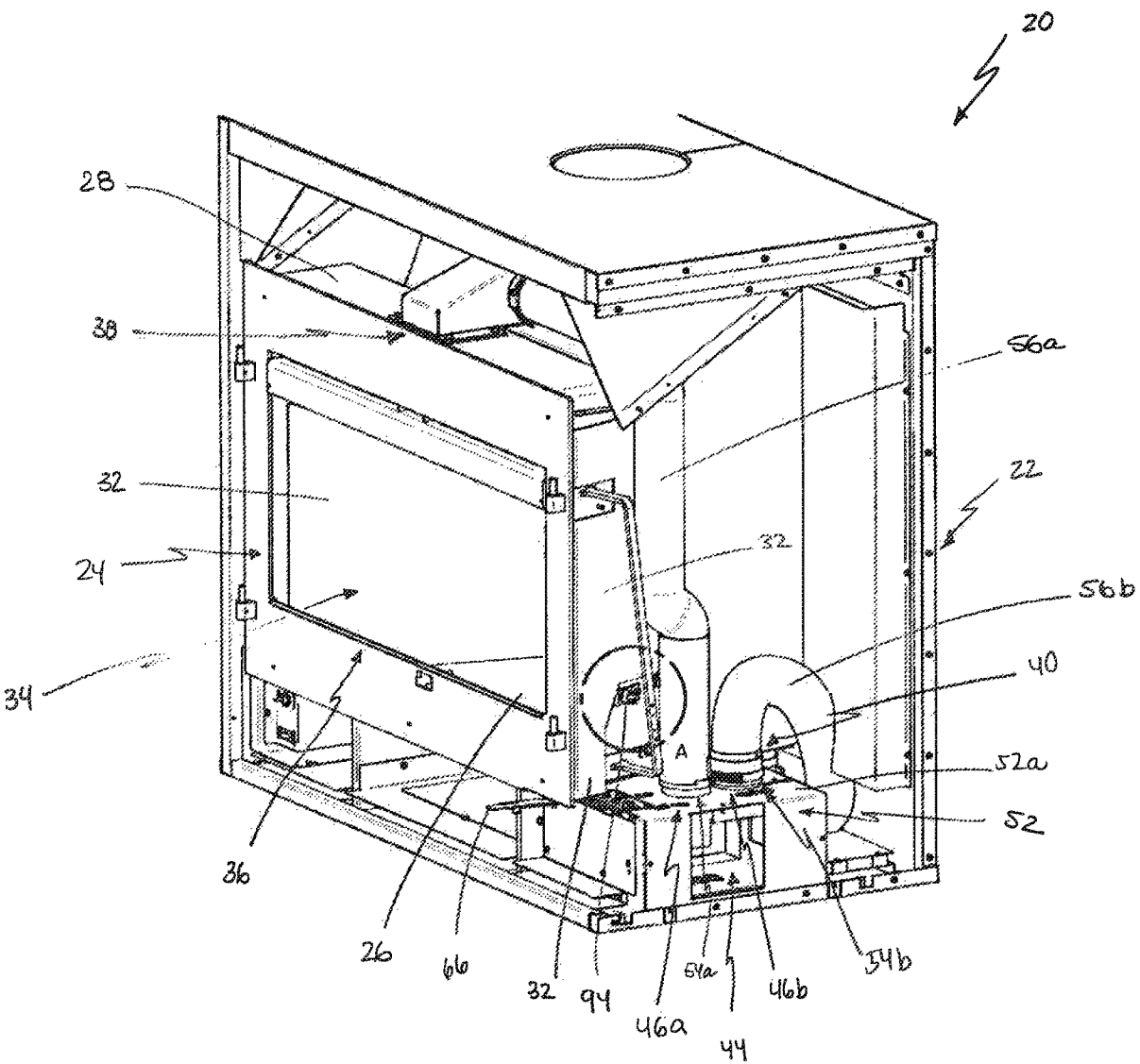
FIG. 1 is a side perspective view of a solid fuel burning appliance including an air intake control assembly in accordance with an embodiment, wherein the air intake control assembly includes a combination of mechanical and electrical components.

In the following description, there are described various embodiments related to a solid fuel burning appliance including an air intake control assembly for controlling an air intake into a combustion chamber of the solid fuel burning appliance. There are also described various embodiments related to a method for controlling an air intake into a combustion chamber of a solid fuel burning stove. It will be noted that in the drawings, the same numerical references refer to similar elements.

Although the embodiments of an air intake control assembly for a combustion chamber of a solid fuel burning stove and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the air intake control assembly for a combustion chamber of a solid fuel burning stove, as will be briefly explained herein and as can be easily inferred herefrom by a person skilled in the art.

It will be appreciated that positional descriptions such as "above", "below", "left", "right", "inwardly", "outwardly", "vertical" and the like should, unless otherwise indicated, be taken in the context of the figures and should not be considered limiting. In particular, when referring to clockwise and counterclockwise rotations hereinafter, it is to be understood that the direction of rotation is taken from an underneath point of view, i.e. relative to an observer looking underneath the air intake control assembly and in an upward direction.

In general terms, the present disclosure concerns a solid fuel burning appliance that includes a combustion chamber at least partially surrounded by an appliance housing of the solid fuel burning stove. As used herein, the term "solid fuel burning appliance" refers to any appliance that can be used to produce heat by combusting a solid fuel, such as and without being limitative a fireplace, a furnace, a stove, a fireplace insert, and the like. The solid fuel burning appliance comprises an air intake control assembly to control combustion air being introduced into the combustion chamber through an air path defined between an appliance air inlet and the combustion chamber. Accordingly, the air intake control assembly allows the solid fuel burning appliance to burn a solid fuel under different regimen, depending of the air intake allowed to enter the combustion chamber. The air intake control assembly functions either using a combination of a manual mode and an auto-regulated mode, or an auto-regulated mode, sometimes combined with a manual mode, to facilitate an optimization of the combustion rate. The characteristics of the air intake control assembly are made possible, amongst others, by a temperature sensor, such as a temperature limit switch, used in combination with a motor that influences the configuration of at least one shutter, this configuration modulating an air flow, and therefore an oxygen flow, being introduced into the combustion chamber of the solid fuel burning appliance to regulate the combustion rate of the solid fuel inside the combustion chamber and thus the temperature in proximity of the combustion chamber. The temperature sensor, such as the temperature limit switch, can advantageously influence the configuration of the at least one shutter depending on a temperature monitored in proximity of the combustion chamber. The air intake control assembly can be used to auto-regulate the air intake within the combustion chamber, which may be desirable for instance to decrease particulate matter emanating from solid fuel combustion and/or increase the efficiency of the solid fuel burning appliance.

Having discussed the general context of the air intake control assembly for a combustion chamber of a solid fuel burning appliance, optional embodiments will be discussed further hereinbelow. The embodiments according to the following description are given for exemplification purposes only.

In accordance with a first aspect and referring to FIG. 1, a solid fuel burning appliance 20 according to an embodiment is shown. The solid fuel burning appliance 20 includes an appliance housing 22 and a combustion chamber housing 24 surrounded by the appliance housing 20, i.e. the combustion chamber housing 24 is contained in the appliance housing 22. In an alternative embodiment, it is appreciated that the appliance housing 20 can only partially surround or contain the combustion chamber housing 24. In an embodiment, the solid fuel burning appliance 20 is a high efficiency appliance. The solid fuel may be for instance and without being limitative wood, coal, charcoal briquettes, ecological logs, wood pellets or other cellulosic fibers. The combustion chamber housing 24 has a bottom wall 26, a top wall 28, a rear wall (not shown) and two side walls 32 defining a combustion chamber 34. The combustion chamber housing 24 has a front opening 36, which may be covered for instance by a hinged door panel (not shown). In an embodiment, the hinged door panel can include a glass window as currently known in the art. In the embodiment shown, the combustion chamber housing 24 also includes a primary combustion chamber air inlet 38 provided in the top wall 28 and a secondary combustion chamber air inlet 40 provided in proximity of the bottom wall 26. As used herein, the appellation "primary" and "secondary" is to differentiate the two combustion chamber air inlets for the purpose of the present description, but it is to be understood that the two terms can be used interchangeably, i.e. in other implementations, the primary combustion chamber air inlet 38 can be referred to as a secondary combustion chamber air inlet and the secondary combustion chamber air inlet 40 can be referred to as a primary combustion chamber air inlet.

In the embodiment illustrated in FIG. 1, the primary combustion chamber air inlet 38 can allow for air to flow against an interior surface of the glass door covering the combustion chamber 34 to contribute to the cleaning the interior surface of the glass door, for instance by preventing soot and fly ash to stick to the glass. The primary combustion chamber air inlet 38 can carry oxygen closer to the bottom wall 26 of the combustion chamber housing 24 to facilitate the ignition and the maintaining of the solid fuel combustion. In some implementations, the secondary combustion chamber air inlet 40 can include secondary air tubes (not shown). The secondary air tubes can be located above a zone where the solid fuel combustion takes place in the combustion chamber 34. The secondary air tubes can have multiple small apertures to contact the residual gases produced by the solid fuel combustion with oxygen. In some implementations, the secondary combustion chamber air inlet 40 can contribute to ignite the residual gases.

It is appreciated that, in an alternative embodiment (not shown), the combustion chamber housing can include a single combustion chamber air inlet or more than two combustion chamber air inlets. For instance, in some implementations, a third combustion chamber air inlet can be provided in the bottom wall 26 of the combustion chamber housing 24, which could also be called a primary combustion chamber air inlet, or in proximity of the chimney which could be called a tertiary combustion chamber air inlet, to further control the air intake in the combustion chamber 34. In other implementations, the combustion chamber air inlet (s) may be defined at other locations of the combustion chamber housing 24. For instance, in some implementations, the primary and the secondary combustion chamber air inlets 38, 40 can be provided at other locations than the locations shown in FIG. 1.

The appliance housing 22 includes an appliance air inlet 44 in fluid communication with the primary and secondary combustion chamber air inlets 38, 40 of the combustion chamber housing 24. Combustion air channels 46*a*, 46*b* therefore extend between the appliance air inlet 44 and the primary and secondary combustion chamber air inlets 38, 40 to allow air from outside the appliance housing 22 to enter into the combustion chamber 34.

The solid fuel burning appliance 20 includes an air intake control assembly 50 contained inside an inner space defined by the appliance housing 22. In an embodiment, the air intake control assembly 50 is provided between the appliance housing 22 and the combustion chamber housing 24 and intersects with the combustion air channels 46*a*, 46*b*, as will be described in more detail below. Still referring to FIG. 1, in the embodiment shown, the air intake control assembly 50 includes a mounting structure 52, such as a metal plate, mounted to at least one of the appliance housing 22 and the combustion chamber housing 24. In the embodiment shown, the mounting structure 52 includes at least one air intake opening 54. In the illustrated embodiment, the at least one air opening includes two air intake openings, i.e. a primary air opening 54*a* and a secondary air opening 54*b*. It is appreciated that, in an alternative embodiment, the mounting structure 52 can include one or more than two air intake openings. The two air intake openings 54*a*, 54*b* extend within the combustion air channels 46*a*, 46*b*, i.e. are aligned with a respective one of the combustion air channels 46*a*, 46*b* and they are in gas communication with a respective one of the combustion air channels 46*a*, 46*b*.

In the illustrated embodiment, the mounting structure 52 of the air intake control assembly 50 is mounted to the at least one of the appliance housing 22 and the combustion chamber housing 24 at a bottom right corner of the solid fuel burning appliance 20. In alternative embodiments, the mounting structure 52 of the air intake control assembly 50 may be mounted at any location around or in close proximity of the combustion chamber 34, as long as the fluid communication between the appliance air inlet 44 and the primary and secondary combustion chamber air inlets 38, 40 is maintained and the air intake openings 54*a*, 54*b* extend within, i.e. they are in gas communication with the combustion air channels 46*a*, 46*b*, as will be explained in more detail hereinafter.

The two air intake openings 54*a*, 54*b* are in gas communication with the appliance air inlet 44. Thus, the air path between the appliance air inlet 44 and the two air intake openings 54*a*, 54*b* defines a first portion of the combustion air channels 46*a*, 46*b*. A second portion of the combustion air channels 46*a*, 46*b* is defined between the two air intake openings 54*a*, 54*b* and the primary and secondary combustion chamber air inlets 38, 40. A primary combustion air flow flows in the combustion air channel 46*a* extending between the appliance air inlet 44 and the primary combustion chamber air inlet 38 through the primary air intake opening 54*a*, while a secondary combustion air flow flows in the combustion air channel 46*b* extending between the appliance air inlet 44 and the secondary combustion chamber air inlet 40 through the secondary air intake opening 54*b*.

The primary and secondary primary combustion air flows may have distinct roles with regard to the functioning of the solid fuel burning appliance 20. For instance, in an embodiment, the primary combustion air flow may serve as a primary air entry, which could contribute mainly to the combustion of the fuel and to the cleaning of the glass door covering the combustion chamber 34. In the embodiment wherein the primary combustion air flow serves as a primary entry, the secondary combustion air flow may serve as a secondary air entry, which could contribute to burn particulate matter emanating from the fire, and to increase efficiency of the solid fuel burning appliance 20.

Still referring to FIG. 1, the solid fuel burning appliance 20 further includes a primary and a secondary combustion air ducts 56*a*, 56*b*, defining a portion of the combustion air channels 46*a*, 46*b*. At one end, the primary combustion air duct 56*a* is secured to the mounting structure 52, surrounds the primary air intake opening 54*a*, and is in fluid communication therewith and therefore in fluid communication with the appliance air inlet 44. Similarly, the secondary combustion air duct 56*b* is secured to the mounting structure 52, surrounds the secondary air intake opening 54*b*, and is in fluid communication therewith and therefore in fluid communication with the appliance air inlet 44. At opposed ends, the primary and the secondary combustion air ducts 56*a*, 56*b* are secured to the combustion chamber housing 24, surround respectively the primary and secondary combustion chamber air inlets 38, 40, and are in fluid communication with the combustion chamber 34. It is to be understood by a person skilled in the art that other configurations of the primary and secondary combustion air ducts, the appliance air inlet and the combustion chamber air inlet may be possible to allow air from outside the appliance housing of the solid fuel burning appliance to enter the combustion chamber. For instance, in an embodiment, the number of combustions air ducts corresponds to the number of air intake openings.

Figure 2:
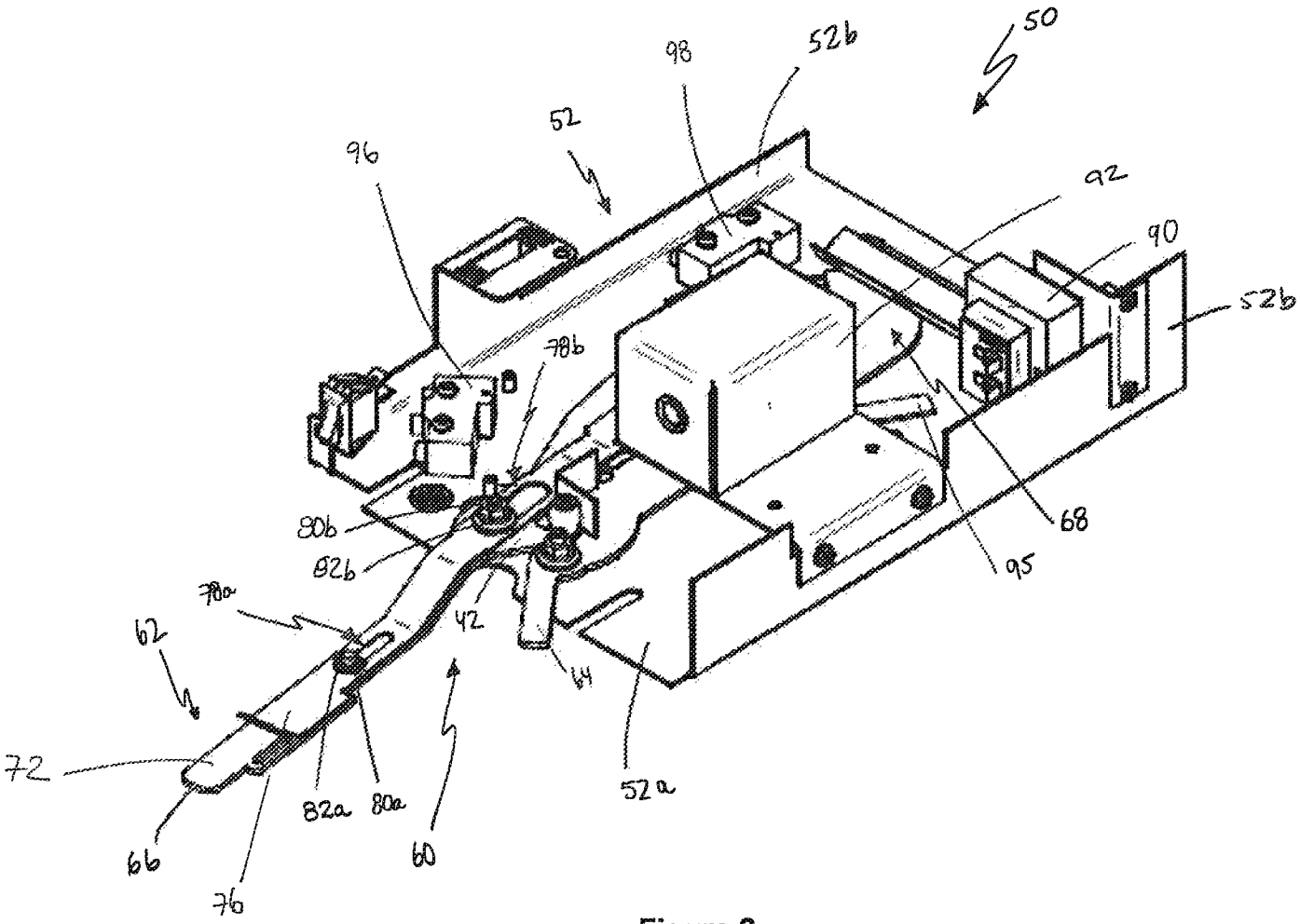
FIG. 2 is a side perspective view of the air intake control assembly shown in FIG. 1.
Figure 3:
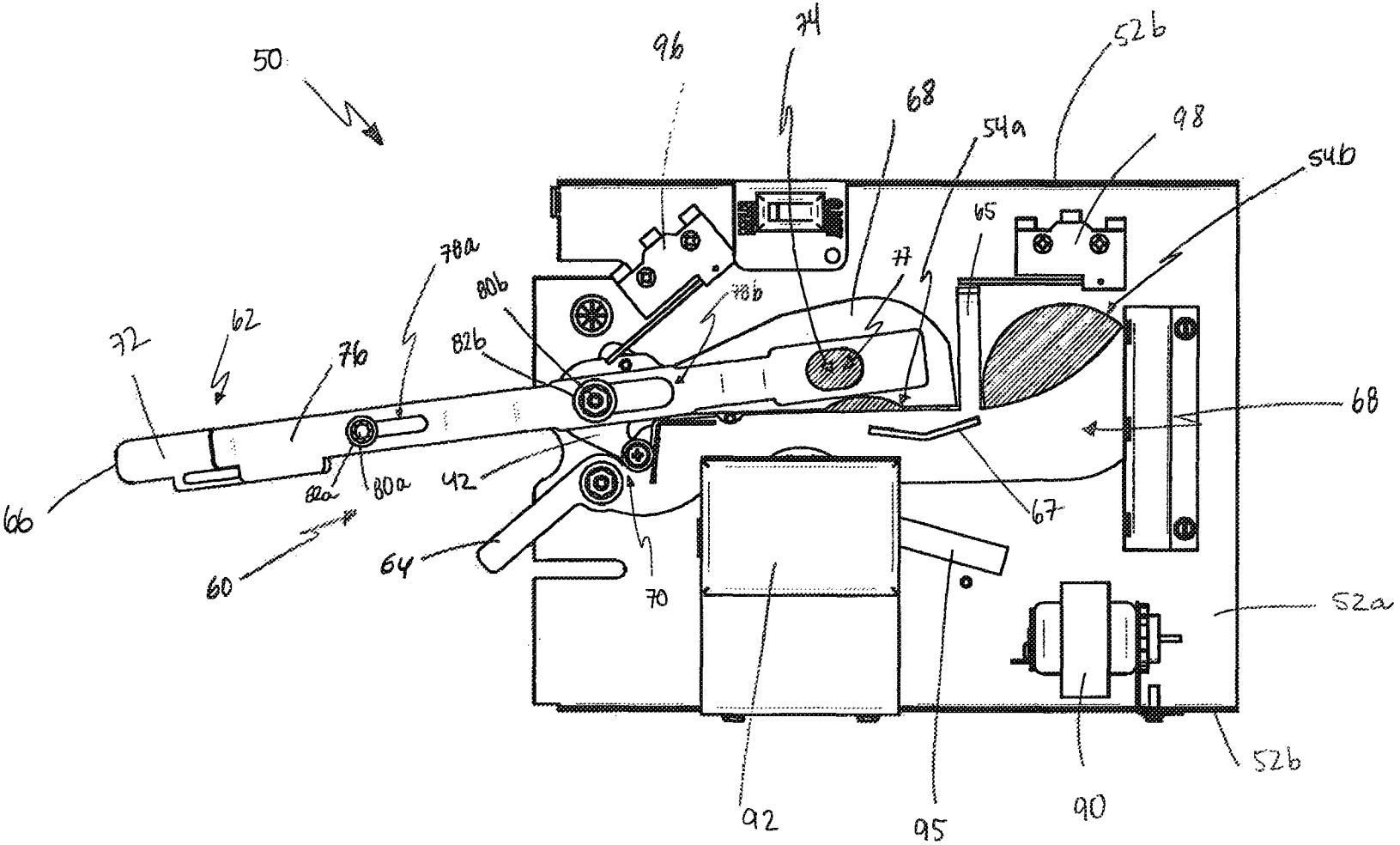
FIG. 3 is a bottom plan view of the air intake control assembly shown in FIG. 2, wherein each one of a primary pivotable arm and a secondary pivotable arm is configured in a closed configuration.
Figure 4:
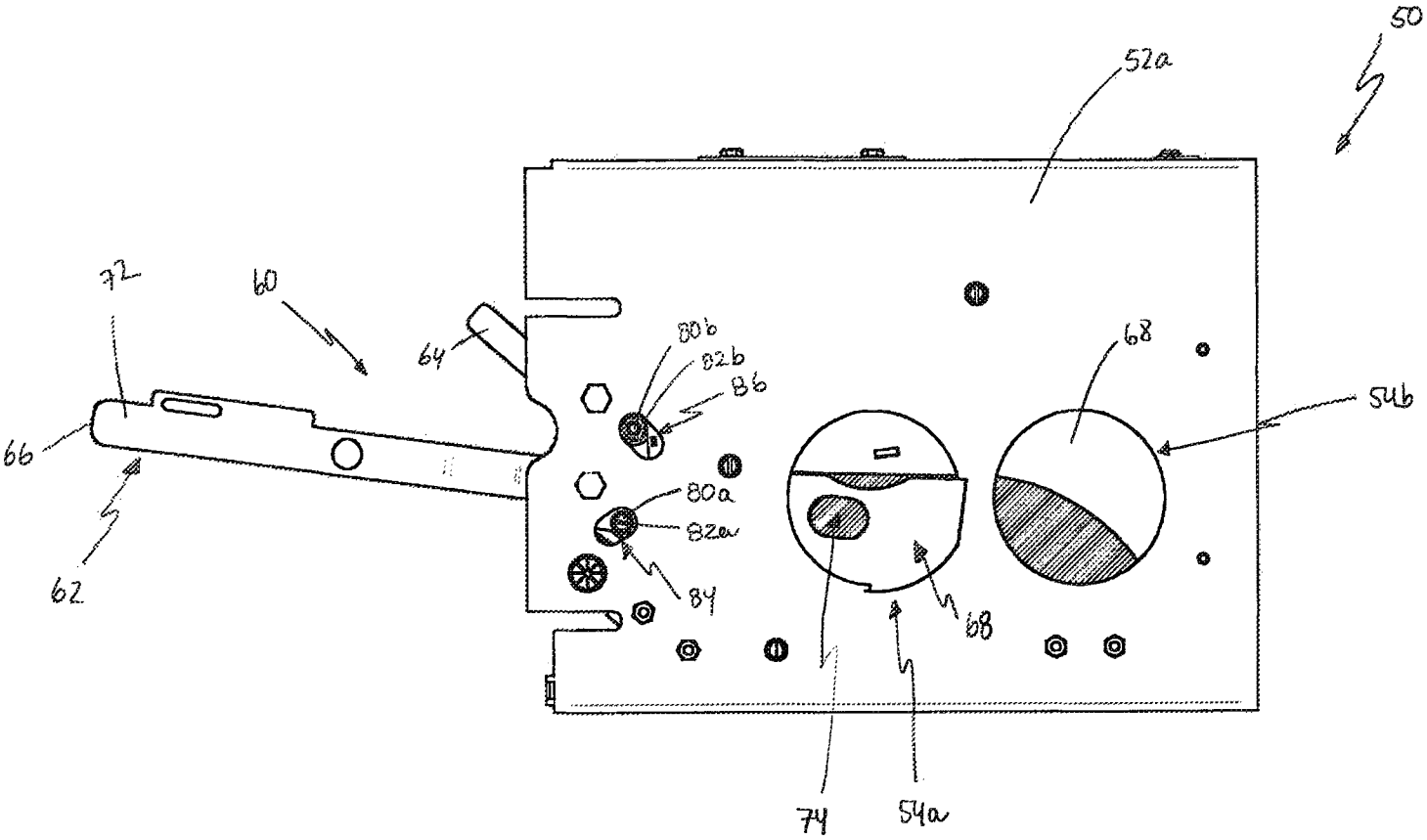
FIG. 4 is a top plan view of the air intake control assembly shown in FIG. 2, wherein each one of the primary pivotable arm and the secondary pivotable arm is configured in the closed configuration.

Referring now to FIGS. 2, 3 and 4, there is shown that the mounting structure 52 includes a mounting plate with a top section 52*a* and side sections 52*b*, extending downwardly on lateral sides of the top section 52*a*, but it is to be understood by the person skilled in the art that other configurations are also possible. For instance, in other implementations, the side sections 52*b* may be absent from the mounting structure 52, or the mounting structure 52 may further include at least one of a rear wall, a front wall and a bottom surface. In another embodiment, the mounting structure 52 is received in an air intake control assembly receiving portion of the solid fuel burning appliance 20 and mounted thereto, the air intake control assembly receiving portion being mounted to the at least one of the appliance housing 22 and the combustion chamber housing 24. The mounting structure 52 may made for instance of steel, but it is to be understood by a person skilled in the art that in other implementations, the mounting structure 52 can be made of any materials that can resist the temperatures surrounding the combustion chamber 34, for instance and without being limitative aluminum, plastic, carbon fiber, fiberglass, cast iron or titanium.

In the embodiment shown and referring to FIGS. 3 and 4, the primary and secondary air intake openings 54*a*, 54*b* defined in the mounting structure 52 have a substantially circular shape, and are designed such that they represent a predetermined proportion of a total surface area of the top section 52*a* of the mounting structure 52, this proportion being sufficient to contribute to supply air within the combustion chamber 34.

Referring to FIGS. 2, 3 and 4, in the illustrated embodiment, the air intake control assembly 50 includes a shutter 60. In the embodiment shown, the shutter 60 includes a primary pivoting arm 62 and a secondary pivotable arm 64 mounted to the mounting structure 52. In an embodiment, the primary pivotable arm 62 is pivotable between a first open configuration and a first closed configuration, and the secondary pivotable arm 64 is pivotable between a second open configuration and a second closed configuration. In the embodiment shown, each one of the primary and secondary pivotable arms 62, 64 pivots about a respective pivot axis, spaced-apart from one another. Alternatively, the primary and secondary pivotable arms 62, 64 may pivot about a same pivot axis, for instance in a situation wherein the primary and the secondary pivotable arms 62, 64 are superposed. In the embodiment shown, the primary pivotable arm 62 includes an actuable handle portion 66 at one end. The handle portion 66 extends outwardly from the mounting structure 52 and outwardly of the appliance housing 22 to be accessible to the user (see FIG. 1). At the opposed end, each one of the primary and secondary pivotable arms 62, 64 includes an air opening obstruction portion 68 superposable to a respective one of the primary and secondary air intake openings 54*a*, 54*b*. In the embodiment shown, the primary pivoting arm 62 is configured to at least partially cover the primary air intake opening 54*a*, and the secondary pivoting arm 64 is configured to at least partially cover both the primary and secondary air intake openings 54*a*, 54*b*. It is to be understood by the person skilled in the art that in other implementations, other configurations of the primary and secondary pivoting arm 62, 64 are possible to at least partially cover the primary and/or secondary air intake openings 54*a*, 54*b*.

In the embodiment shown, the secondary pivoting arm 64 includes an outwardly extending segment 65 extending outwardly towards one of the side walls 52*b*, and a downwardly extending flange 67, the purpose of which will be explained in more detail hereinbelow. In the embodiment shown, the primary and secondary pivotable arms 62, 64 are substantially flat. In another embodiment, the primary and secondary pivotable arms 62, 64 may be thicker and/or have a different shape. It will be also readily understood by a person skilled in the art that other contours of the air opening obstruction portion 68 are also possible and are to be determined taking into consideration the complimentary shape of the air intake openings 54*a*, 54*b* and the characteristics of the combustion chamber 34.

The shutter 60 is configurable between an open configuration and an at least partially closed configuration such that a section of the shutter 60 at least partially covers the at least one air intake opening 54 defined in the mounting structure 52. In the embodiment shown, the section of the shutter 60 that at least partially covers the at least one air intake opening 54 is the air opening obstruction portion 68. In an embodiment, the shutter 60 is displaceable, for instance, by pivoting and/or translation between the open configuration and the at least partially closed configuration. It is to be understood by a person skilled in the art that any other type of movement allowing the shutter 60 to be displaceable with respect to the at least one air intake opening 54 is within the scope of the air intake control assembly 50.

Referring to FIG. 3, in the embodiment shown, the primary and secondary pivotable arms 62, 64 are interconnected through an interconnecting flange 42 of the primary pivotable arm 62 being received in a receiving portion 70 defined in the secondary pivotable arm 64. In an embodiment, a pivoting movement of the primary pivotable arm 62, and thus of the interconnecting flange 42 received within the receiving portion 70 of the secondary pivotable arm 64, engages the secondary pivotable arm 64 to simultaneously react to the pivoting movement. This feature will be described in more detail hereinbelow.

In the embodiment shown, the primary pivotable arm 62 further includes a main shutter plate 72 having a primary pivotable arm opening 74 defined therein and an auxiliary shutter 76 having an auxiliary air intake opening 77 defined therein. The auxiliary shutter 76 is superposed to and translatable along the main shutter plate 72. In the embodiment shown, the auxiliary shutter 76 translates substantially parallelly and underneath the main shutter plate 72 of the primary pivotable arm 62. More particularly, it translates between an open configuration wherein the primary pivotable arm opening 74 and the auxiliary air intake opening 77 are aligned (or in register), i.e. air can flow therethrough, and a closed configuration wherein the primary pivotable arm opening 74 and the auxiliary air intake opening 77 are spaced-apart and the auxiliary shutter 76 covers the primary pivotable arm opening 74, i.e. air is prevented to flow therethrough. The open and closed configurations of the auxiliary shutter 76 will be described in more detail below. In another embodiment, the auxiliary shutter 76 is received above the main shutter plate 72 of the primary pivotable arm 62. In another embodiment (not shown), the secondary pivoting arm 64 can include an auxiliary shutter. It is also envisioned that each one of the primary pivotable arm 62 and the secondary pivoting arm 64 can include a respective auxiliary shutter.

In the illustrated embodiment, the auxiliary shutter 76 includes a primary and a secondary grooves 78*a*, 78*b*, into which are inserted a respective bolt 80*a*, 80*b* extending normally and upwardly from the main shutter plate 72 of the primary pivotable arm 62. The assembly including the main shutter plate 72 having bolts 80*a*, 80*b* extending through the primary and the secondary grooves 78*a*, 78*b* defined in the auxiliary shutter plate 76 is secured using a nut 82*a*, 82*b* engaged with a respective one of the bolts 80*a*, 80*b*. The bolt, nut, and groove assemblies guide the translation of the auxiliary shutter 76 with respect to the main shutter plate 72. The bolt, nut, and groove assemblies in the illustrated embodiment could also be replaced, in another embodiment, by a groove-and-tongue mechanism or a rail system. It is to be understood by the person skilled in the art that other types of engagement between the primary pivotable arm 62 and the auxiliary shutter 76 are also suitable.

As mentioned above, the auxiliary shutter 76 further includes the auxiliary air intake opening 77 defined therein and that the auxiliary shutter 76 is translatable longitudinally with respect to the main shutter plate 72 of the primary pivotable arm 62. It is also contemplated that the auxiliary shutter 76 may be displaced through a movement other than a translation, for instance a pivot. In an embodiment wherein the auxiliary shutter 76 is pivoted, the corresponding grooves would be designed accordingly.

In the embodiment shown in FIG. 3, the auxiliary air intake opening 77 of the auxiliary shutter 76 is aligned with the primary pivotable arm opening 74 of the main shutter plate 72, which corresponds to a configuration where the auxiliary shutter 76 is translated inwardly towards a center of the mounting structure 52. This also corresponds to an open configuration of the auxiliary shutter 76. Typically, the auxiliary air intake opening 77 is configured in the open configuration when the primary pivoting arm 62 is in the closed configuration, to allow for a small air flow to enter into the combustion chamber 34 if required. For configuring the auxiliary shutter 76 in the closed configuration, the translatable shutter 76 is translated outwardly, towards the actuable handle portion 66 wherein the primary pivotable arm opening 74 is spaced apart from the air intake opening 77 and the primary pivotable arm opening 74 is covered by the auxiliary shutter 76, preventing air from flowing therethrough and thereby further reducing the air flow into the combustion chamber in the closed configuration of the primary pivoting arm 62. In an embodiment, the feature of displacing the auxiliary shutter 76 from the open configuration to the closed configuration is controlled by the user, whereas in other embodiments, this feature may be auto-regulated. It is appreciated that the auxiliary shutter 76 can be configured in any intermediate configuration between the open and the closed configurations.

Referring to FIG. 4, there is shown that the top section 52*a* of the mounting structure 52 of the air intake control assembly 50 includes a primary pivotable arm through-hole 84 and a secondary pivotable arm through-hole 86. In the embodiment shown, the primary and secondary through-holes 84, 86 have an oblong shape and are each positioned to receive therein a respective one of the bolts 80*a*, 80*b* and nuts 82*a*, 80*b* to guide the primary and secondary pivotable arms 62, 64 when they are pivoting. It is to be understood by a person skilled in the art that in the embodiment wherein the shutter 60 is displaced through another type of movement than pivoting to cover the at least one air intake opening 54, a position and a shape of the primary and secondary pivotable arm through-holes 84, 86 would be determined accordingly.

Referring to FIGS. 2 and 3, the air intake control assembly 50 further includes a power supply 90 connectable to a power source, and a motor 92, the power supply 90 and the motor 92 being mounted to the side section 52*b* of the mounting structure 52. The motor 92, such as and without being limitative a damper motor, is operatively connected to the shutter 60 and, more particularly, the secondary pivoting arm 64, as will be described in more detail below. In the illustrated embodiment, the power supply 90 includes a transformer, such as and without being limitative a 120V/24V transformer, connectable to an electric current supply, as it is known in the art. The air intake control assembly 50 also includes an electric circuit (not shown), including a plurality of electric connectors, connecting the power supply 90 to the motor 92 to drive same. In the embodiment shown, the motor 92 drives a lever 95 adapted to apply a force on the secondary pivoting arm 64 when predetermined conditions are met, as will be explained in more detail hereinafter.

Referring to FIGS. 1 to 4, the air intake control assembly 50 includes a temperature sensor and, more particularly, a temperature limit switch 94, which could be referred to as a mechanical thermostat, a primary shutter limit switch 96, and a secondary shutter limit switch 98. The primary limit switch 96 and the secondary limit switch 98 are positioned spaced-apart to respectively contact the primary pivoting arm 62 and the secondary pivoting arm 64 in predetermined configurations thereof, as will be described in more detail below. In this embodiment, the limit switches 96, 98 are normally closed limit switches. In other implementations, the limit switches 96, 98 can be normally open limit switches, or a combination of both. In the embodiment shown, the primary shutter limit switch 96 and the secondary shutter limit switch 98 are contact limit switches. It is to be understood by a person skilled in the art that other types of limit switches can be used to detect a position of the shutter 60 and influence the passage of an electric current through the electric circuit.

The electric circuit, including a plurality of electric connectors, electrically connects the power supply 90 to the motor 92 through the temperature limit switch 94, the primary shutter limit switch 96 and the secondary shutter limit switch 98 in a series connection. Thus, if at least one of the temperature limit switch 94, the primary shutter limit switch 96 and the secondary shutter limit switch 98 is configured in an open configuration, electric current from the power supply 90 is prevented from reaching the motor 92.

In the illustrated embodiment, the temperature limit switch 94 monitors a temperature in proximity of the combustion chamber 34 of the solid fuel burning appliance 20. In an embodiment, the temperature limit switch 94 may be located outside the solid fuel burning appliance 20, while still in proximity to the combustion chamber 34, or the temperature limit switch 94 may be located closer to the combustion chamber 34. In another embodiment, the temperature limit switch 94 may be located inside the combustion chamber 34 of the solid fuel burning appliance 20, or inside a chimney (not shown). In the embodiment shown, the temperature limit switch 94 is mounted to the combustion chamber housing 24. The temperature limit switch 94 is configurable in a closed configuration to allow an electric current to pass therethrough, and in an open configuration to prevent an electric current to pass therethrough. In an embodiment, the temperature limit switch 94 is a normally open limit switch and is configurable in the closed configuration to allow current to pass therethrough when the monitored temperature is equal to or above a combustion control temperature threshold. Alternatively, in another embodiment, the air intake control assembly 50 includes a temperature limit switch and a temperature sensor provided in proximity of the combustion chamber 34 of the solid fuel burning appliance 20 to monitor the temperature in proximity of the combustion chamber 34, the temperature sensor being operatively connected to the temperature limit switch.

In some implementations, factors other than the temperature measured in proximity of the combustion chamber 34 can be monitored and taken into consideration to influence the air intake in the combustion chamber 34. For instance, the air intake control assembly 50 can include a pressure gauge mounted to the solid fuel burning appliance 20 to monitor a pressure in the chimney. Changes in air pressure in the chimney can influence the flow regimen of the air, and thus the oxygen provided to the fire, which in turn can influence the intensity of the combustion of the solid fuel. The air intake control assembly 50 can thus include a pressure limit switch that includes the pressure gauge to monitor the pressure in the chimney. In such implementations, the electric circuit electrically connects the power supply 90 to the motor 92 through the temperature limit switch 94, the pressure limit switch, the primary shutter limit switch 96 and the secondary shutter limit switch 98 in a series connection. Thus, if at least one of the temperature limit switch 94, pressure limit switch, the primary shutter limit switch 96 and the secondary shutter limit switch 98 is configured in an open configuration, electric current from the power supply 90 is prevented from reaching the motor 92. In other implementations, the weight of the solid fuel can also be monitored, which can contribute to improving the efficiency of the combustion.

The primary and secondary shutter limit switches 96, 98 are configured to detect at least one position of a respective one of the primary pivoting arm 62 and the secondary pivoting arm 64 of the shutter 60. In the embodiment wherein the primary and secondary shutter limit switches 96, 98 are normally closed limit switches, the primary and secondary shutter limit switches 96, 98 are configurable in an open configuration upon detection of the at least one position of the respective one of the primary pivoting arm 62 and the secondary pivoting arm 64, which prevents electric current to pass therethrough and to reach the motor 92. The primary and secondary shutter limit switches 96, 98 are configured in the closed configuration otherwise, which allows electric current to pass therethrough and to reach the motor 92.

In the embodiment wherein the shutter 60 includes a single pivotable arm, the air intake control assembly 50 can include only one shutter limit switch configured to detect at least one position of the shutter 60 or two or more shutter limit switches, each one being configured to detect a respective position of the shutter 60. For instance, if the air intake control assembly 50 includes only one shutter limit switch, the shutter limit switch can be configured to detect the open configuration of the shutter 60. If the air intake control assembly 50 includes two shutter limit switches, a first one of the shutter limit switches can be configured to detect the open configuration of the shutter 60 and a second one of the shutter limit switches can be configured to detect the closed configuration of the shutter 60.

Similarly, in the embodiment wherein the shutter 60 includes the primary pivoting arm 62 and the secondary pivoting arm 64, the air intake control assembly 50 can include only one shutter limit switch configured to detect at least one position of at least one of the primary pivoting arm 62 and the secondary pivoting arm 64, i.e. the open or the closed configuration.

In the embodiment shown including the primary limit switch 96 and the secondary limit switch 98, the primary shutter limit switch 96 is positioned such that when the shutter 60, including both the primary pivoting arm 62 and the secondary pivoting arm 64, is in the open configuration, a physical contact is made between the primary shutter limit switch 96 and the primary pivoting arm 62, while there is an absence of contact between the secondary limit switch 98 and the secondary pivoting arm 64 and vice-versa when the shutter 60 is in the closed configuration. In this embodiment, the primary shutter limit switch 96 is configured in the closed configuration upon physical contact with the primary pivoting arm 62, i.e. when the shutter 60 is in the open configuration, in which case an electric current is prevented to pass therethrough and to reach the motor 92. Furthermore, upon removal of the physical contact, for instance when the shutter 60 is positioned in an at least partially closed configuration, the primary shutter limit switch 96 is configured in the closed configuration thereby allowing the electric current to pass therethrough and to reach the motor 92. In opposite fashion, the secondary shutter limit switch 98 is configured in the open configuration upon physical contact with the secondary pivoting arm 64, i.e. when the shutter 60 is in the closed configuration, in which case the electric current is prevented to pass therethrough and to reach the motor 92. Upon removal of the physical contact, for instance when the shutter 60 is positioned in the open configuration or at least partially open configuration, the secondary shutter limit switch 98 is configured in the closed configuration thereby allowing an electric current to pass therethrough and to reach the motor 92.

In an embodiment, the primary and the secondary shutter limit switches 96, 98 are mounted in series, and both the primary and the secondary limit switches 96, 98 are required to be in the closed configuration to allow electric current to pass therethrough and reach the motor 92.

The electric circuit connects the motor 92 to the power supply 90 through the temperature limit switch 94, or through the temperature limit switch 94 and the shutter limit switches 96, 98 in the embodiment wherein the air intake control assembly 50 includes at least one shutter limit switch. In accordance with an embodiment, the electric circuit is in an open configuration when at least one of the temperature and shutter limit switches 94, 96, 98 is in the open configuration to prevent electric current to reach the motor 92.

According to a second aspect, there is provided a method for controlling the air intake into the combustion chamber 34 of the solid fuel burning appliance 20, using the air intake control assembly 50 as described herein.

Figure 5A:
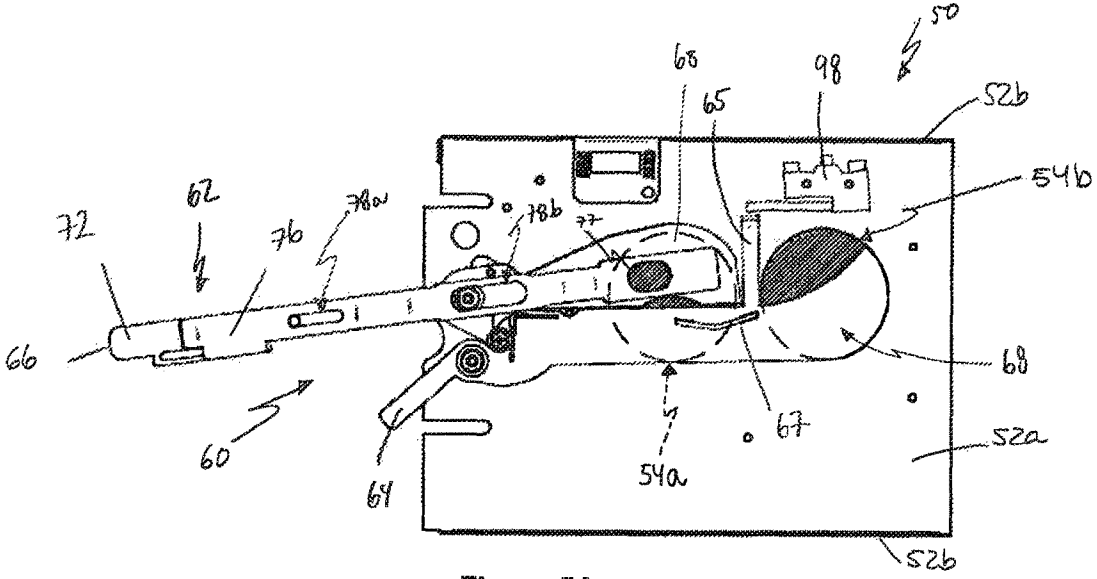
FIG. 5A is a bottom plan view of the air intake control assembly shown in FIG. 2, wherein the primary and secondary pivotable arms are configured in the closed configuration, and an auxiliary shutter is configured in an open configuration.
Figure 5B:
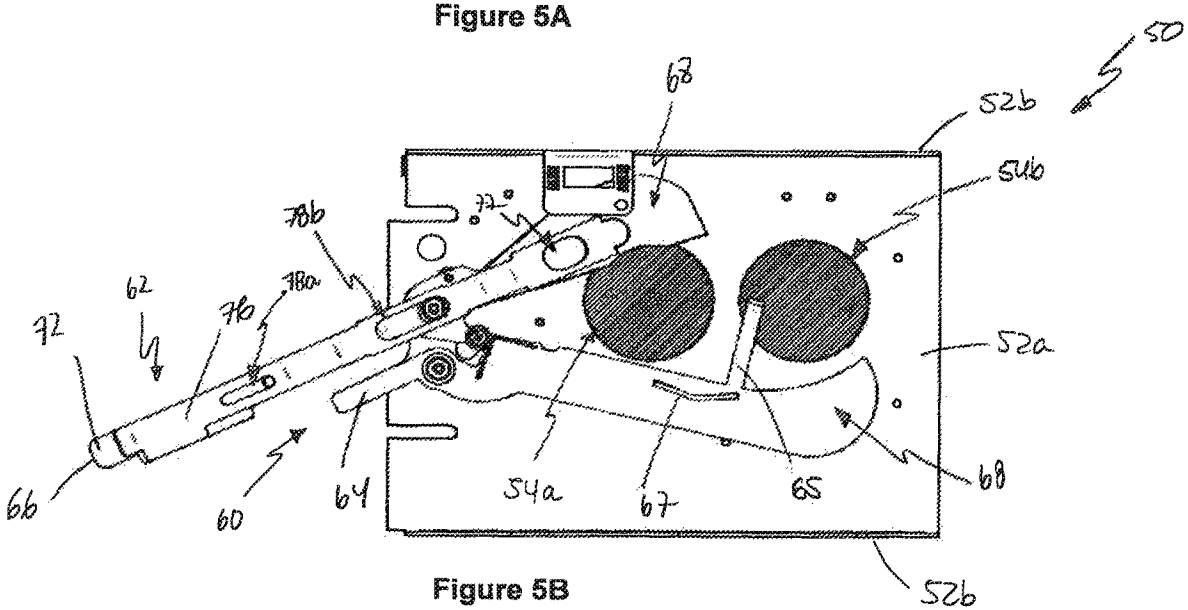
FIG. 5B is a bottom plan view of the air intake control assembly shown in FIG. 2, wherein the primary and secondary pivotable arms are configured in an open configuration, and the auxiliary shutter is configured in a closed configuration.
Figure 5C:
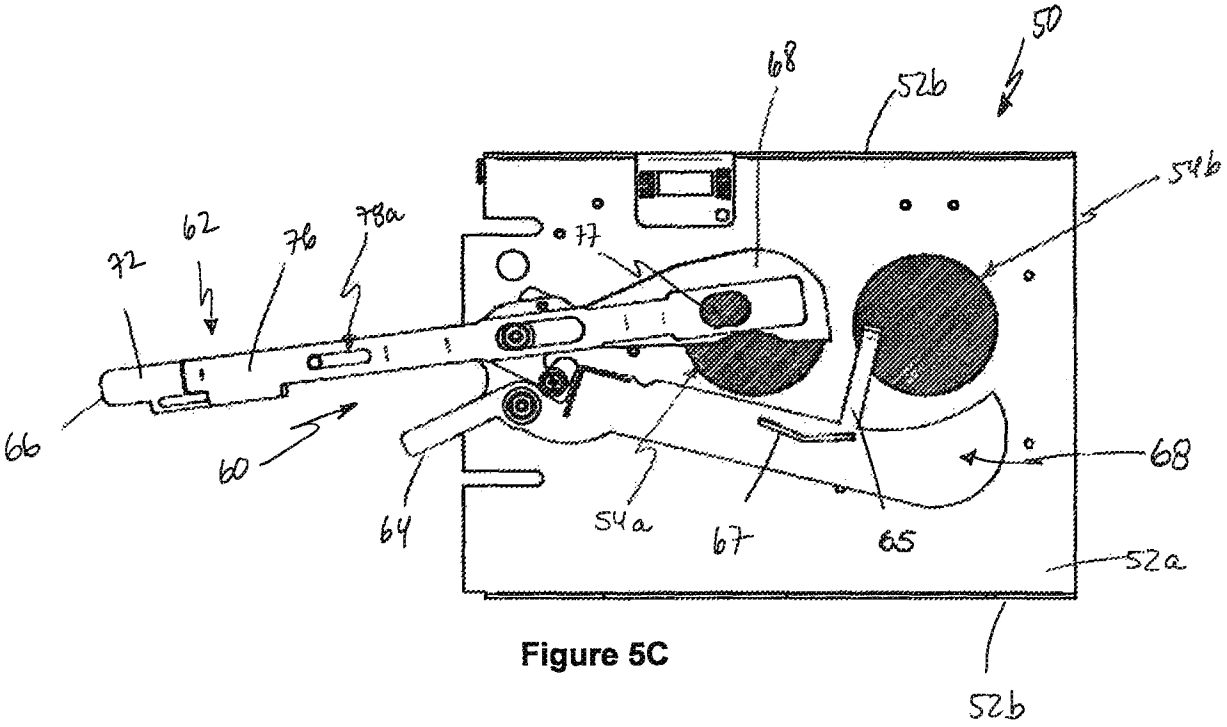
FIG. 5C is a bottom plan view of the air intake control assembly shown in FIG. 2, wherein the primary pivotable arm is configured in the closed configuration, the secondary pivotable arm is configured in the open configuration, and the auxiliary shutter is configured in the open configuration.
Figure 6:
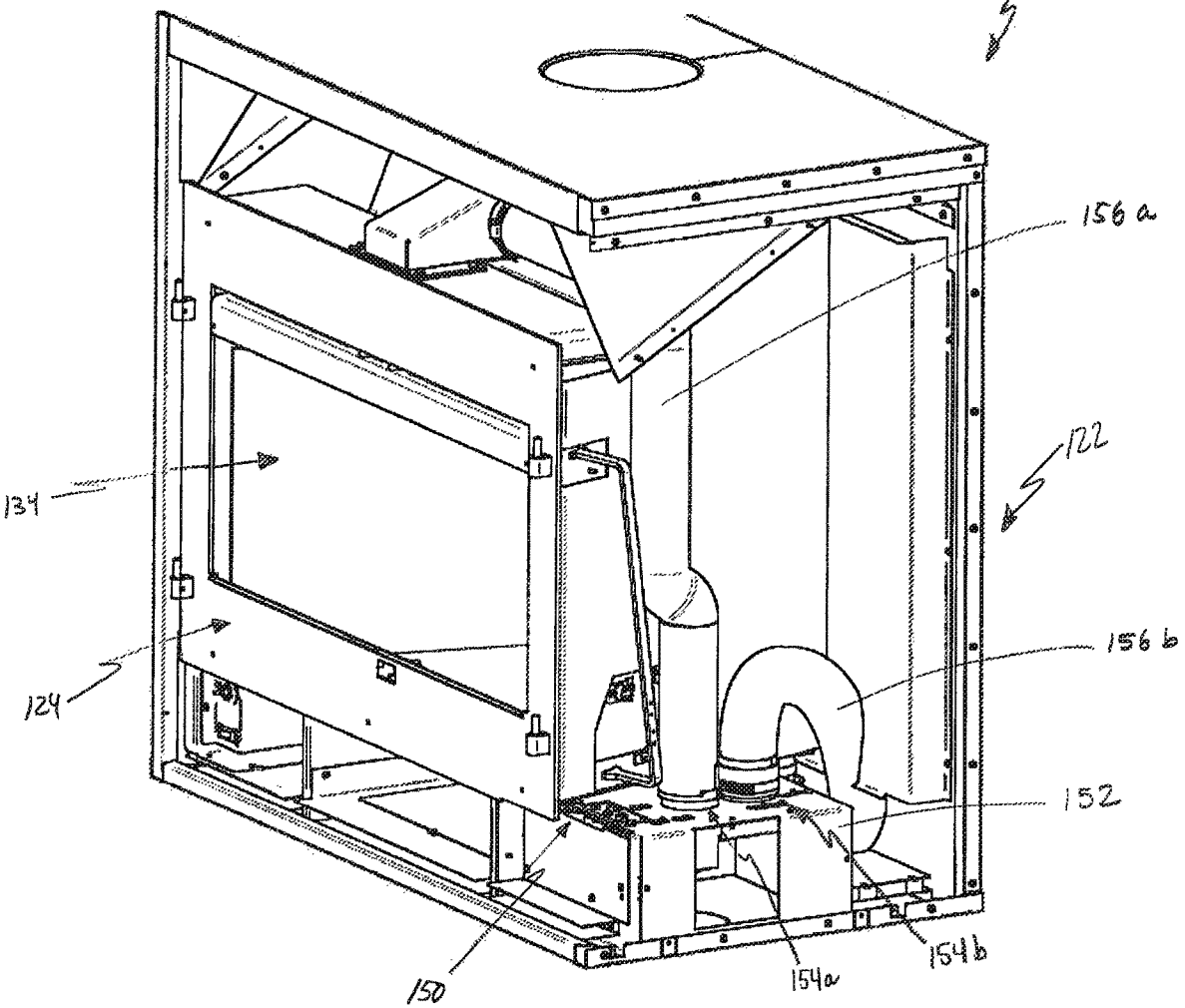
FIG. 6 is a side perspective view of a solid fuel burning appliance including an air intake control assembly in accordance with another embodiment, wherein the air intake control assembly includes mostly electronic components.

The method is described with reference to FIGS. 5A-5C depicting the various configurations of the air intake control assembly 50 as it goes through the method steps, from the open configuration to the closed configuration. The air intake control assembly 50 shown in FIGS. 5A-5C is substantially similar to the one described above in reference to FIGS. 1-4, except that some features are been omitted to simplify the schematization of the methods steps.

Prior to the method steps and in reference to FIG. 5A, the shutter 60 includes the primary and secondary pivotable arms 62, 64. In the embodiment shown, the shutter 60 is in the closed configuration with both the primary and secondary pivotable arms 62, 64 being configured in the closed configuration, wherein the outwardly extending segment 65 of the secondary pivoting arm 64 is positioned to physically contact the secondary shutter limit switch 98, while there is an absence of physical contact between the primary pivoting arm 62 and the primary shutter limit switch 96. In such a configuration, since at least one of the primary shutter limit switch 96 and the secondary shutter limit switch 98 is in the open configuration, the electric current is prevented to pass and to reach the motor 92. In the embodiment shown, the auxiliary shutter 76 is configured in the open configuration. However, it could be configured in the closed configuration. For instance, it could be manually configured in the closed configuration by a user.

Then, in reference to FIG. 5B, to ignite a fire in the combustion chamber 34, the shutter 60 is manually configured in the open configuration. To do so, the primary pivoting arm 62 is pivoted in the open configuration and until there is a physical contact between the primary shutter limit switch 96 and the primary pivoting arm 62. Simultaneously, the secondary pivoting arm 64 is pivoted through the action of the interconnecting flange 42. The pivot of the secondary pivoting arm 64 results in the absence of physical contact between the secondary pivoting arm 64 and the secondary shutter limit switch 98. Again, in such a configuration, since at least one of the primary shutter limit switch 96 and the secondary shutter limit switch 98 is in the open configuration, the electric current is prevented to pass and to reach the motor 92. In the embodiment shown, the auxiliary shutter 76 has been manually translated outwardly in the closed configuration. However, it could be configured in the open configuration.

Then, when the fire is well ignited in the combustion chamber 34 and it may be desirable to reduce the combustion air flow therein, the primary pivoting arm 62 is configured in a non-open configuration. In an embodiment, the primary pivoting arm 62 is manually configured in a non-open configuration by a user. A position of the shutter 60 with respect to the at least one air intake opening 54*a*, 54*b* is detected. In reference to FIG. 5C, the detected position corresponds to a non-open configuration of the shutter 60 and, more particularly, of the primary pivotable arm 62, with respect to the primary air intake opening 54*a*. In the illustrated embodiment, the non-open configuration corresponds to the primary pivoting arm 62 being pivoted back to a close configuration, independently of the secondary pivoting arm 64. The secondary pivoting arm 64 therefore remains in the open configuration. In this position, neither the primary pivoting arm 62 nor the secondary pivoting arm 64 is in physical contact with the primary shutter limit switch 96 and the secondary shutter limit switch 98, respectively. Thus, the primary and secondary shutter limit switches 96, 98 are both in the closed configuration, and the electric current is allowed to pass therethrough.

A temperature in proximity of the combustion chamber 34 is monitored by the temperature limit switch 94. This temperature is compared to a combustion control temperature threshold by the temperature limit switch 94.

Then, if the monitored temperature is equal or above the combustion control temperature threshold, the temperature limit switch 94 adopts the closed configuration, allowing electric current to pass therethrough. Therefore, at this point, the primary and secondary shutter limit switches 96, 98 and the temperature limit switch 94 are all in the closed configuration and allow electric current to pass therethrough and to reach the motor 92. Otherwise, until the temperature in proximity of the combustion chamber 34, monitored by the temperature limit switch 94, is below the combustion control temperature threshold, the temperature limit switch 94 is configured in the open configuration, preventing electric current to pass therethrough.

When the electric current reaches the motor 92, the motor 92 activates the lever 95 such that the lever 95 pushes the downwardly extending flange 67 of the secondary pivoting arm 64 to further close the primary and secondary air intake openings 54*a*, 54*b*. The motor 92 is activated until the outwardly extending segment 65 of the secondary pivoting arm 64 physically contacts the secondary shutter limit switch 98 once again. Upon physical contact, the electric current no longer reaches the motor 92 and the motor 92 stops. At this point, the shutter 60 has resumed the closed position shown in FIG. 5A. Once the motor 92 is stopped, the lever 95 returns to its original position, for instance through the action of a bias means such as a spring.

In FIGS. 5A-5C, the auxiliary shutter 76 translationally transitions between the closed configuration and the open configuration for fine-tuning the modulation of the air flow being introduced into the combustion chamber 34 of the solid fuel burning appliance 20, thereby contributing to further regulate the combustion rate of the solid fuel inside the combustion chamber 34. In this embodiment, and in reference to FIGS. 5A and 5C, when the auxiliary shutter 76 is in the open configuration, an additional small air flow is allowed to enter the combustion chamber 34 through the alignment of the auxiliary air intake opening 77 with the primary pivotable arm opening 74, which can contribute to increase the combustion rate of the solid fuel. Alternatively, in another embodiment, if the auxiliary shutter 76 is translated in the closed configuration when the primary pivoting arm 62 is in the closed configuration as in FIGS. 5A and 5C, no additional air flow would be allowed through this air flow path, which can contribute to reduce the combustion rate of the solid fuel in the combustion chamber 34. In the illustrated embodiment, when the primary pivoting arm 62 is in the open configuration and therefore when the primary pivotable arm air opening 74 is not substantially aligned with the primary air opening 54*a*, no additional air flow enters the combustion chamber 34.

It will be appreciated that the method described herein may be performed in the described order, or in any suitable order.

In an exemplified use of the air intake control assembly, a user of the solid fuel burning appliance may choose for instance to allow a maximum air flow to enter the combustion chamber, for instance when igniting a fire in the combustion chamber or to obtain a maximum burning rate, by placing the shutter in an open configuration. When the user wishes to reduce the burning rate, the user may do so by placing the at least one shutter of the air intake control assembly in a configuration that impairs the air intake into the combustion chamber and therefore the amount of oxygen contributing to the combustion of the fuel. This position of the at least one shutter may be referred to as an at least partially closed configuration. In an embodiment, these two steps are performed manually by the user. Then, given the characteristics of the air intake control assembly, the auto-regulated mode may take over. In the auto-regulated mode, the user may not be required to adjust the air intake manually if he does not wish to do so. In the auto-regulated mode, the at least one shutter is designed to remain in the at least partially closed configuration until a temperature in proximity of the combustion chamber reaches a combustion control temperature threshold, which then triggers the at least one shutter to adopt a closed configuration wherein the air intake into the combustion chamber is decreased, which can contribute to decreasing the burning rate of the fuel in the combustion chamber and/or avoiding the production of smoke. The configuration of the at least one shutter in the closed configuration depending on the temperature measured in proximity to the combustion chamber through a motor would be referred to as the auto-regulated mode. As such, the air intake into the combustion chamber can be either manually adjusted or be auto-regulated, depending on the needs of the user.

Referring to FIGS. 6 to 10C and according to a third aspect, there is shown a second embodiment of a solid fuel burning appliance 120 including an air intake control assembly 150 wherein the features are numbered with reference numerals in the 100 series, which correspond to the reference numerals of the first embodiment with the following adaptations.

The features of the appliance housing 122 and the combustion chamber housing 124, surrounded by the appliance housing 20, are similar to the ones described in reference to the solid fuel burning appliance 20 and will not be described in further details.

Referring to FIGS. 6 to 9, the air intake control assembly 150 includes a mounting structure 152 including a mounting plate with a top section 152*a* and side sections 152*b*, which is similar to the mounting structure 52 and will not be described in further details. It is to be understood by the person skilled in the art that other configurations are also possible.

Figure 7:
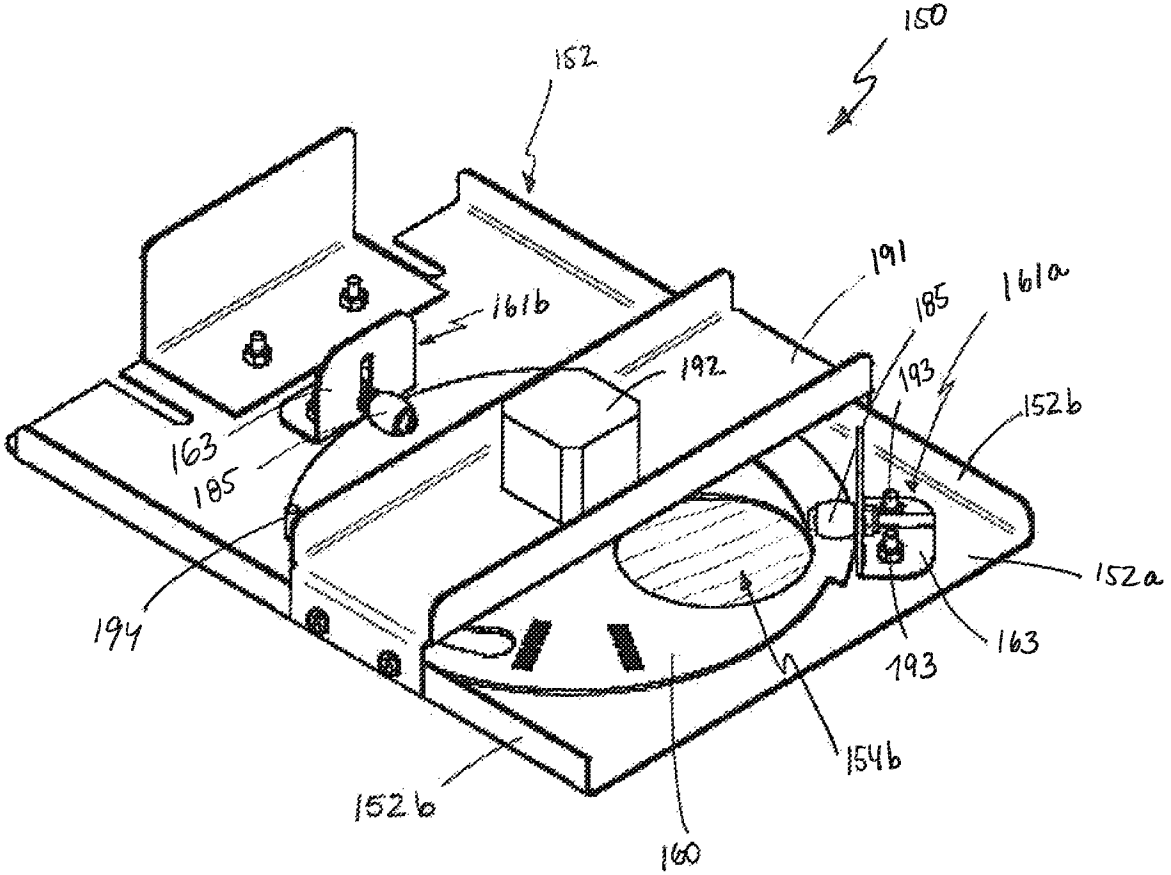
FIG. 7 is a bottom perspective view of the air intake control assembly shown in FIG. 6.
Figure 8:
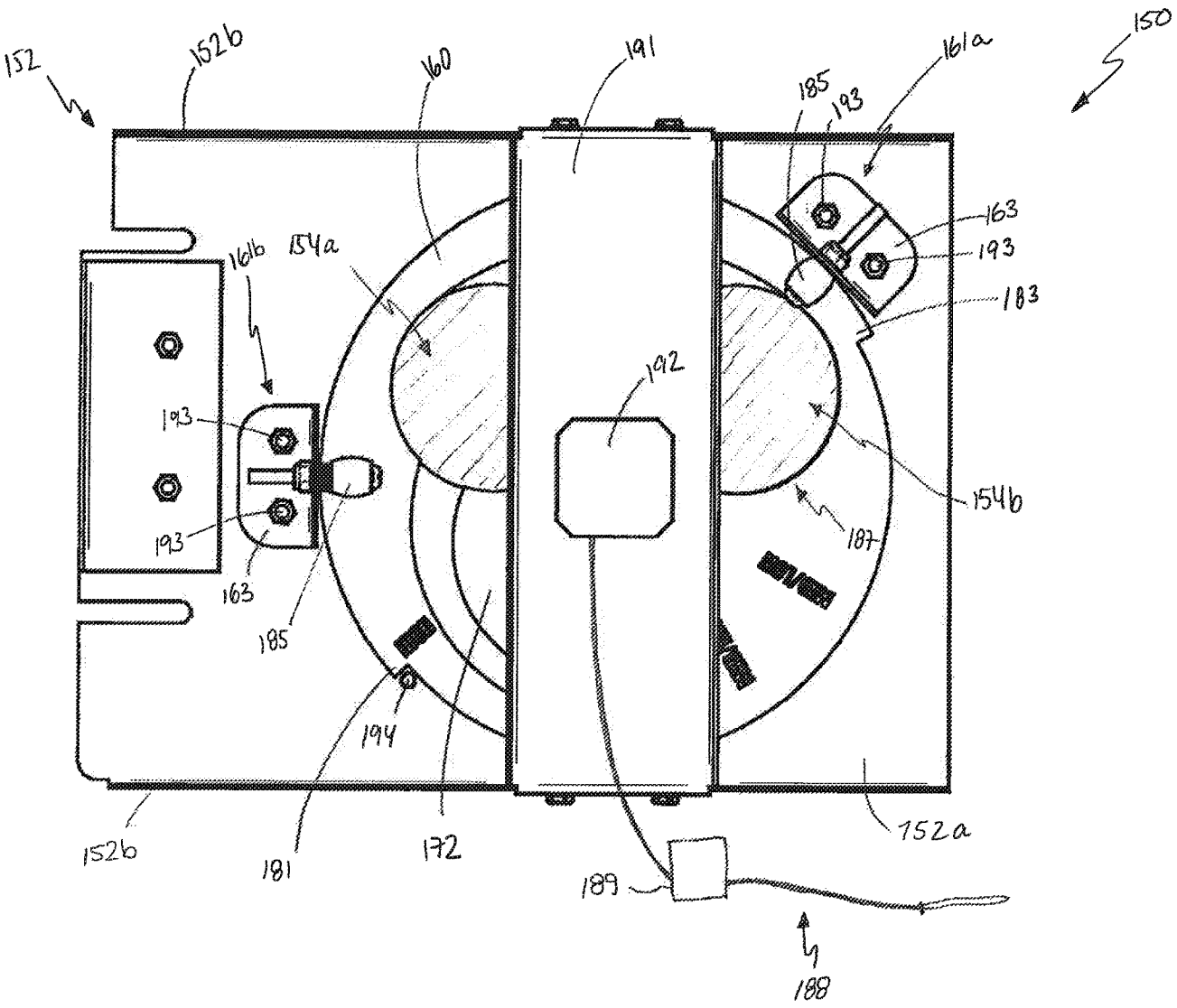
FIG. 8 is a bottom plan view of the air intake control assembly shown in FIG. 7, wherein a shutter is configured in an open configuration.
Figure 9:
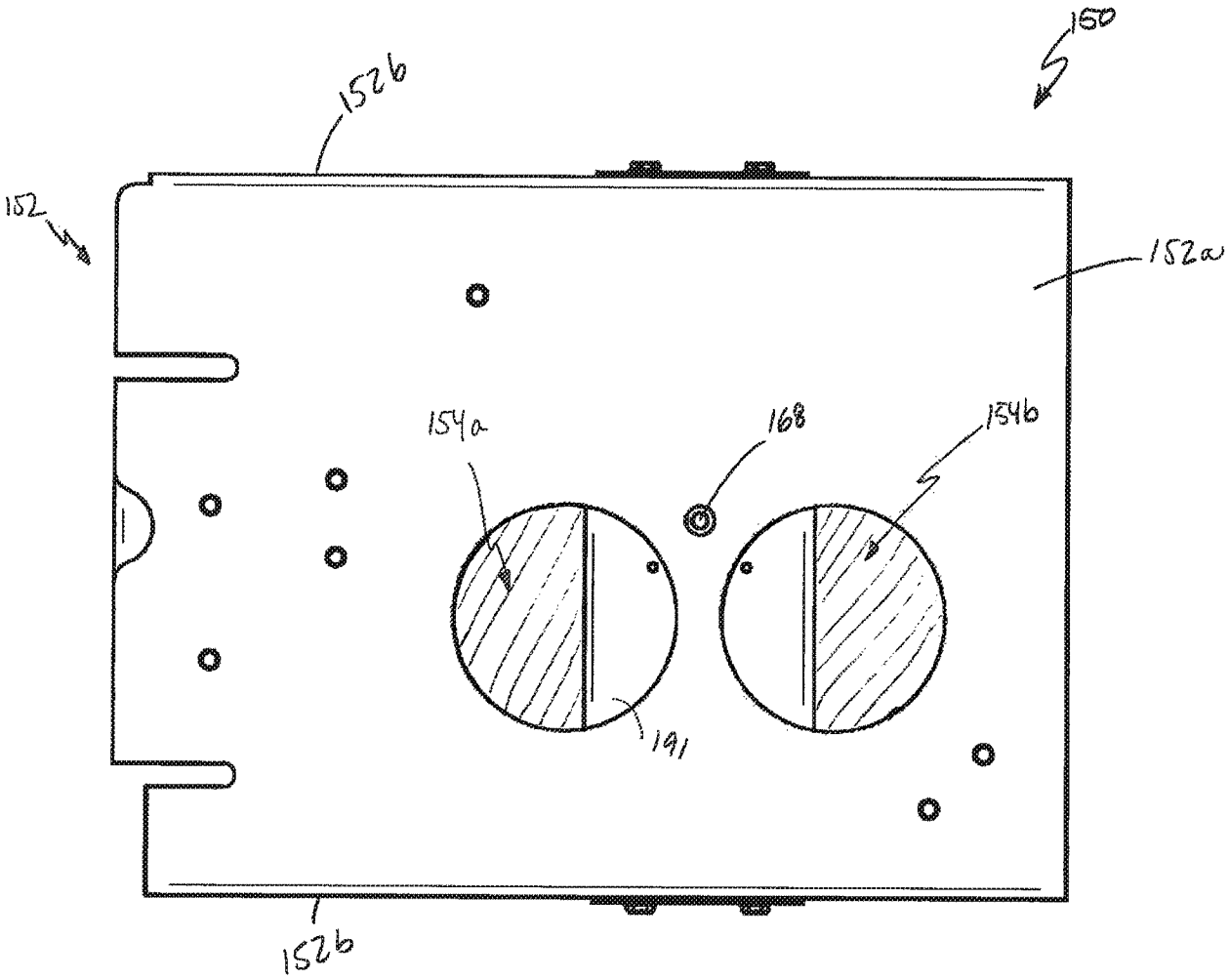
FIG. 9 is a top plan view of the air intake control assembly shown in FIG. 7, wherein the shutter is configured in the open configuration.

In the embodiment shown in FIGS. 7 to 9, the primary and secondary air intake openings 154*a*, 154*b* defined in the mounting structure 152 have a substantially circular contour, and are designed such that they represent a given proportion of a total surface area of the top section 152*a* of the mounting structure 152, this proportion being sufficient to supply air within the combustion chamber 134.

Still referring to FIGS. 7 to 9, in the illustrated embodiment, the air intake control assembly 150 includes a shutter 160 and two shutter stabilizers 161*a*, 161*b*. In the embodiment shown, the shutter 160 includes a substantially flat and circular plate and is superposed above the primary and secondary air intake openings 154*a*, 154*b* defined in the mounting structure 152. As mentioned hereinabove with regard to the primary and secondary pivotable arms 62, 64, in other implementations, the shutter 160 may be thicker and/or have different geometrical shapes, which can be chosen according to the complimentary shape of the air intake openings 154*a*, 154*b* and the characteristics of the combustion chamber 134, such that a relative displacement of the shutter 160 with respect to the air intake openings 154*a*, 154*b*, such as a translation or a rotation of the shutter 160, can at least partially cover the air intake openings 154*a*, 154*b*. Each one of the shutter stabilizers 161*a*, 161*b* includes a mounting element 163 and an abutment wheel 185, the abutment wheel 65 being rotatably mounted to the mounting element 163 such that a segment of the outer circumferential surface of the abutment wheel 185 abuts the shutter 160 and applies pressure thereon. In the embodiment shown, the mounting element 163 is fastened to the top section 152*a* of the mounting structure 152 through a pair of mechanical fastener 193. The abutment wheel 185 is positioned at a given distance relative to the top section 152*a* of the mounting structure 152 such that the shutter 160 is sandwiched between the top section 152*a* of the mounting structure 152 and the outer circumferential surface of the abutment wheel 185 to stabilize the shutter 160 thereinbetween and maintain a physical contact between the shutter 160 and the top section 152*a* of the mounting structure 152.

As mentioned hereinabove, the peripheral shape of the shutter 160 is substantially circular and includes two indentations defined along the circumference of the shutter 160. As shown in FIG. 8, the two indentations provide a first limit stop 181, and a second limit stop 183 positioned approximately at 180° from the first limit stop 181 (or diametrically opposed to the first limit stop 181). Thus, the shutter 160 can be divided into two half-circles with a common center and delimited by the two limit stops 181, 183: one having a larger diameter and one having a narrower diameter.

In the embodiment shown, the shutter 160 includes an air opening obstruction portion 172, the first limit stop 181, and the second limit stop 183 positioned approximately at 180° from the first limit stop 181 (or diametrically opposed to the first limit stop 181). In other implementations, the first limit stop 181 and the second limit stop 183 can be positioned at another angle relative to each other than 180°. In implementations for which the angle between the first limit stop 181 and the second limit stop 183 is less than 180°, an additional mechanical reduction system, such as a drivetrain, can be used to rotate the motor 192. The shutter 160 includes a shutter opening 187 defined therein. In the embodiment shown, the shutter opening 187 has an irregular shape with at least a portion thereof being configured to substantially be in register with the contour of the primary and secondary air intake openings 154*a*, 154*b* when aligned therewith. In the embodiment shown, the shutter opening 187 also includes a portion substantially shaped as an arc, the purpose of which will be explained in further detail hereinbelow. It is to be understood by a person skilled in the art that other shapes of the shutter opening 187 are envisioned and are within the scope of the air intake control assembly 150 described herein. The shutter 160 is pivotally mounted to the mounting structure 152 through a pivot 168 (FIG. 9) positioned substantially in a center of the shutter 160, such that the shutter 160 can rotate about a pivot axis aligned with the pivot 168, i.e. substantially normal to the top section 152*a* of the mounting structure 152 and a planar surface of the shutter 160. In the embodiment shown, the pivot 168 is substantially aligned with the common center of the two half-circles of the shutter 160.

The mounting structure 152 further comprises a stopping pin 194 against which either one of the first limit stop 181 and the second limit stop 183 can abut depending on the direction and the extent of rotation of the shutter 160 about the pivot axis. In the embodiment shown, when the shutter 160 is rotated counterclockwise about the pivot axis, from an underneath point of view, the first limit stop 181 abuts the stopping pin 194, whereas when the shutter 160 is rotated clockwise about the pivot axis, from an underneath point of view, the second limit stop 183 abuts the stopping pin 194. In the embodiment shown, when the first limit stop 181 abuts the stopping pin 194, the shutter 160 is in an open configuration, i.e. both the primary and secondary air intake openings 154*a*, 154*b* defined in the mounting structure 152 are fully open (FIG. 10A), and when the second limit stop 183 abuts the stopping pin 194, the shutter 160 is in a closed configuration, i.e. the shutter 160 at least partially covers at least one of the primary and secondary air intake openings 154*a*, 154*b* defined in the mounting structure 152 (FIG. 10C). In the embodiment shown, in the closed configuration, both the primary and secondary air intake openings 154*a*, 154*b* are partially covered by the shutter 160, with a small surface thereof remaining open and allowing airflow therethrough. In the context of the present description, the closed configuration corresponds to the configuration wherein the primary and secondary air intake openings 154*a*, 154*b* are the most covered by the shutter 160, which is not compulsorily a fully-closed configuration wherein both the primary and secondary air intake openings 154*a*, 154*b* are fully covered by the shutter 160 and closed to prevent airflow therethrough. It is to be understood by the person in the art that in other implementations, other closed configurations of the shutter 160 are possible with respect to the primary and secondary air intake openings 154*a*, 154*b*. It will be also readily understood by a person skilled in the art that other shapes of the air opening obstruction portion 172 are possible and are to be determined taking into consideration the complimentary shape of the air intake openings 154*a*, 154*b* and the characteristics of the combustion chamber 134.

Figure 10B:
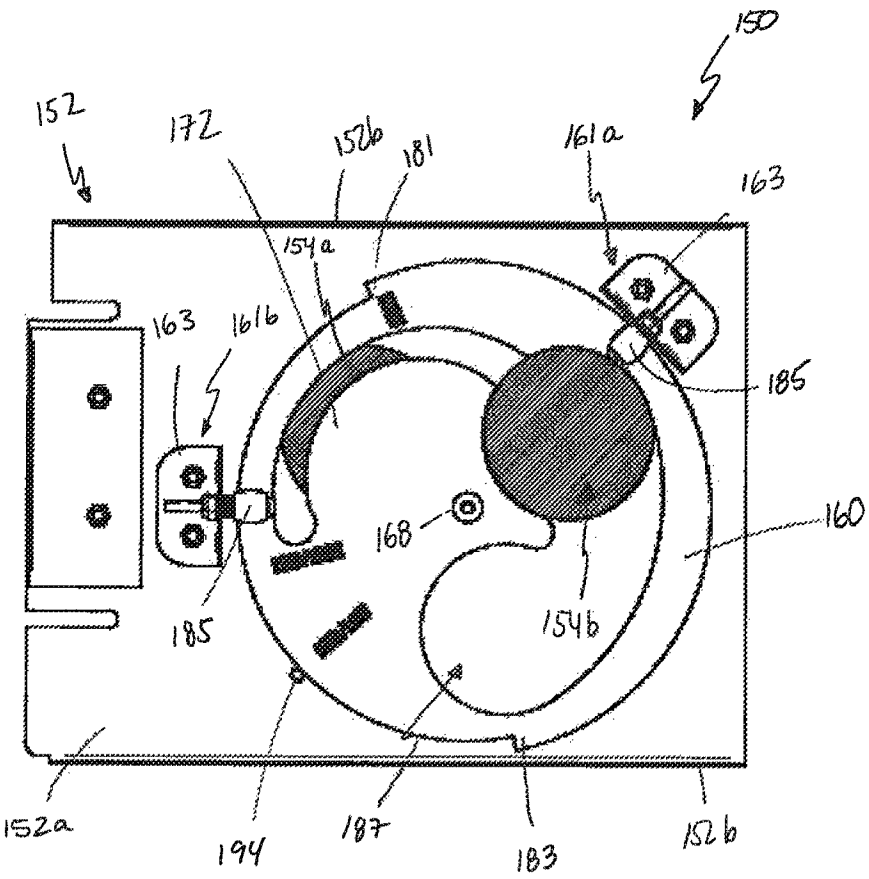
FIG. 10B is a bottom plan view of the air intake control assembly shown in FIG. 7, wherein the shutter is configured in a partially closed configuration.
Figure 10A:
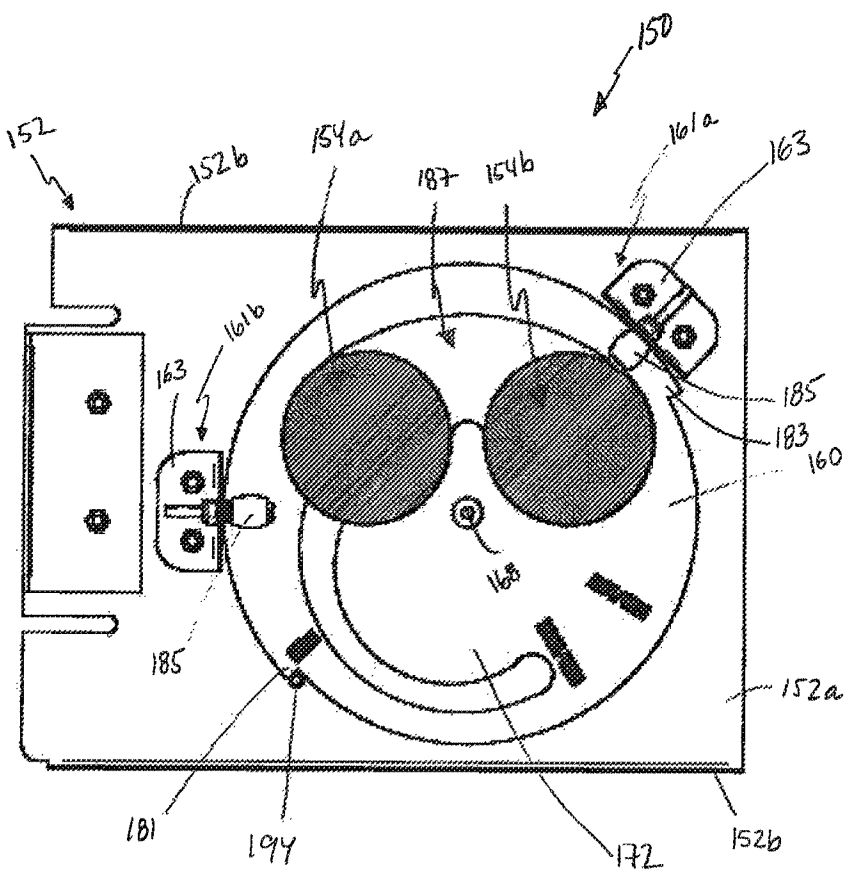
FIG. 10A is a bottom plan view of the air intake control assembly shown in FIG. 7, wherein the shutter is configured in the open configuration with a first limit stop abutting a stopping pin.
Figure 10C:
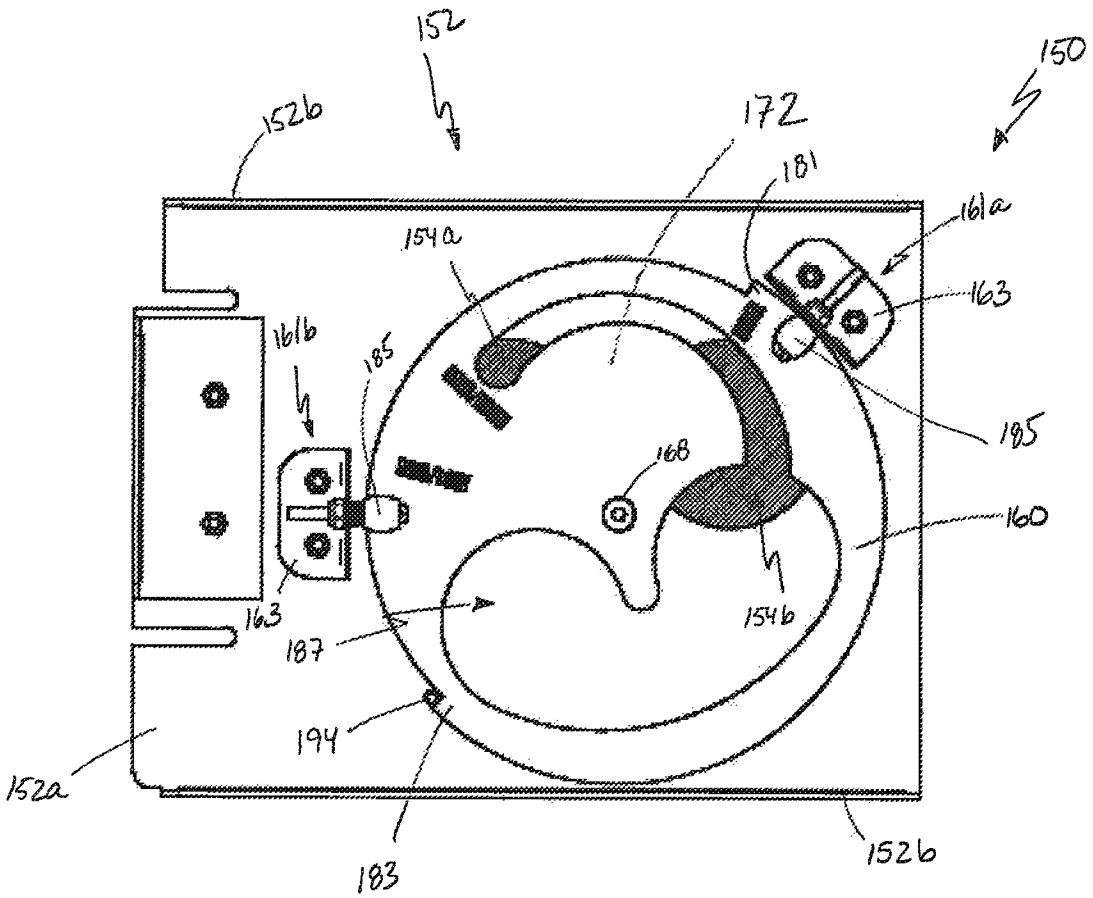
FIG. 10C is a bottom plan view of the air intake control assembly shown in FIG. 7, wherein the shutter is configured in a closed configuration with a second limit stop abutting the stopping pin.

Furthermore, between the open configuration shown in FIG. 10A and the closed configuration shown in FIG. 10C, there exist a plurality of intermediate configurations, as shown in FIG. 10B, allowing an airflow rate between the relatively high airflow obtained in the open configuration and the relatively low airflow (or no airflow) obtained in the closed configuration.

The shutter 160 is configurable to adopt a given configuration with respect to the at least one air opening 154*a*, 154*b*, the configuration being incremental from the open configuration in which both the primary and the secondary air openings 154*a*, 154*b* are fully or mostly unobstructed, i.e. the configuration wherein they are the most uncovered, and the first limit stop 181 abuts the stopping pin 194, to a configuration where at least one of the primary and the secondary air opening 154*a*, 154*b* is mostly covered (or fully covered), i.e. the configuration wherein they are the most covered, and the second limit stop 183 abuts the stopping pin 194, which corresponds to the closed configuration. Any configuration of the shutter 160 between the open configuration and the closed configuration is referred to as an intermediate configuration wherein the primary and the secondary air openings 154*a*, 154*b* are at least partially closed. It is to be understood that all the configurations of the shutter 160 are reversible and depend on the temperature monitored by a temperature sensor in proximity of the combustion chamber 134, as will be described in more detail below. In the embodiment shown, the shutter 160 is rotatable in both a clockwise and a counterclockwise directions, from an underneath point of view.

Referring to FIGS. 7 and 8, the air intake control assembly 150 further includes a power supply (not shown) connectable to a power source, and a motor 192. In the illustrated embodiment, the motor 192 is mounted to a motor structure 191 secured to and positioned at a given distance from the mounting structure 152. It is appreciated that, in an alternative embodiment, the motor 192 can be mounted directly to the mounting structure 152. In the embodiment shown, the motor 192 is a stepper motor having a motor shaft extending upwardly from the motor structure 191 towards the shutter 160, aligned with the pivot axis. More particularly, the motor 192 includes a motor shaft operatively connected with the pivot 168 to engage same in rotation. Thus, the mechanical interaction between the motor shaft and the pivot 168 engages the shutter 160 in rotation either in the clockwise or the counterclockwise direction. Hence, the stepper motor 192 is operatively connected to the shutter 160 to incrementally rotate the shutter 160, as is known in the art. In other implementations, the stepper motor 192 can be positioned in proximity of the shutter 160, and the mechanical interaction between the shutter 160 and the stepper motor 192 can be performed through a drivetrain system, for instance and without being limitative a gear, a chain-sprocket, or a strap-pulley system. The use of a drivetrain system can, in some embodiments, increase the precision of the rotation angle of the shutter 160, and/or reduce the torque required to be exerted by the motor 192.

The air intake control assembly 150 also includes an electric circuit (not shown), including a plurality of electric connectors, connecting the power supply to the motor 192 to drive same. In the embodiment shown, the motor 192 drives the shutter 160 when predetermined conditions are met, as will be explained in more detail hereinafter.

In some embodiments, the stopping pin 194 can be a limit switch, for instance and without being limitative a normally closed contact limit switch, such that when the first limit stop 181 contacts the stopping pin 194, there is an electric signal sent to the controller 189. The controller 189 then opens the electric circuit so that the electric current is prevented to reach the motor 192 and the motor 192 stops, instead of forcing against the stopping pin 194. In some implementations, the stepper motor 192 is configured to rotate a given number of steps even when either one of the first limit stop 181 and the second limit stop 183 already abuts the stopping pin 194 to ensure that one of the open and the closed configurations is reached. This feature further ensures that the open configuration is reset properly.

In the illustrated embodiment, the air intake control assembly 150 includes a temperature sensor 188 to monitor a temperature in proximity of the combustion chamber 134 of the solid fuel burning appliance 120. In an embodiment, the temperature sensor 188 may be located outside the solid fuel burning appliance 120, while still in proximity to the combustion chamber 134, or the temperature sensor may be located closer to or inside the combustion chamber 134. In some implementations, the temperature sensor 188 can be a resistance temperature detector (RTD), a thermocouple or a thermistor. In implementations where the temperature sensor 188 is a resistance temperature detector, the resistance value is correlated to temperature based on the metal used for the resistor. As the temperature of the resistor increases, the electrical resistance also increases. The temperature sensor 88 is operatively connected to the motor 192 such that for a given variation in temperature detected by the temperature sensor 188, the stepper motor 192 is driven for a given number of incremental steps. In some implementations, and as shown in FIG. 3, the temperature sensor 188 is operatively connected to a controller 189, which in turn is operatively connected to the motor 192. In the embodiment shown, the temperature sensor 188 is physically connected to the controller 189. It is appreciated that, in an alternative embodiment (not shown), the temperature sensor 188 can be connected to the controller 189 through a wireless connection.

In an embodiment, the temperature sensor 188 can be a temperature limit switch operatively connected to the motor 192 and configured in an open configuration, preventing electric current passage therethrough, if the monitored temperature is below a predetermined temperature threshold, and is in the closed configuration otherwise, allowing electric current passage therethrough.

In the implementations where the controller 189 is present, the controller 189 can, for instance, receive a temperature measured by the temperature sensor 188 as an input temperature, and the input temperature can then be compared to a temperature threshold to determine a departure from the set temperature, such that the controller 189 can actuate the motor 192 for a given number of incremental steps. For each incremental step of the stepper motor 192, the shutter 160 rotates a given number of degrees about the pivot axis so as to adopt a predetermined configuration with respect to the primary and the secondary air intake openings 154*a*, 154*b*. For instance, the stepper motor 192 can rotate 1.8° for each incremental step, which can also be referred to as a step angle, such that 200 steps are necessary to complete a full revolution of the motor shaft. As will be readily understood by the person skilled in the art, any configuration of the stepper motor 192 allowing the shutter 160 to rotate incrementally for a given step angle are within the scope of the air intake control assembly 150. It is appreciated that the angle variation of the shutter 160 for each step of the stepper motor 192 can vary from the example provided above, i.e. the step angle can be different from 1.8° and the number of steps to complete a full rotation of the motor shaft can vary accordingly.

In an embodiment, when the measured temperature reaches a temperature threshold, for instance a maximal temperature threshold, the stepper motor 192 is driven clockwise, from an underneath point of view, for a given number of closing incremental steps to position the shutter 160 in the closed configuration, thereby reducing the volume of air entering in the combustion chamber 134. As mentioned hereinabove, when the shutter 160 is in the closed configuration, the second limit stop 183 abuts the stopping pin 194. In implementations where the stopping pin 194 is a limit switch, the contact of the second limit stop 183 with the stopping pin 194 stops the stepper motor 192, i.e. it prevents to further rotate in the direction wherein the stopping pin 194 is abutted against a respective one of the limit stops 181, 183. Alternatively, when a predetermined criterion is reached, for instance and without being limitative the duration of the combustion being above a given number of hours in the open configuration, the stepper motor 192 is driven counterclockwise, from an underneath point of view, for a given number of opening incremental steps to position the shutter 160 in the open configuration. In some implementations, when neither the maximal temperature threshold is reached nor the predetermined criterion is met, the stepper motor 192 is driven to actuate the shutter 160 as a function of the temperature detected by the temperature sensor 188 and when applicable, in accordance with the control, such as a logical control algorithm, determined by the controller 189. Various criteria related to the temperature measured in proximity of the combustion chamber 134 can be chosen to influence the rotation of the shutter 160 through the controller 189 and associated rotation of the motor 192. For instance and without being limitative, the rotation of the shutter 160 can be related to the temperature detected as an absolute value, to a change in temperature, to a change in temperature as function of time, to an acceleration of the change in temperature and so on. The relationship can be, for instance, a linear, an exponential or any other suitable relationship. It is to be understood by the person skilled in the art that other criteria and types of relationships between the temperature and rotation of the motor 92 are within the scope of the present application.

In the embodiment where the stopping pin 194 is a shutter limit switch, the stopping pin 194 is configured to detect at least one configuration of the shutter 60. In the embodiment wherein the stopping pin 194 is a normally closed limit switch, the stopping pin 194 is configurable in an open configuration upon detection of the at least one configuration of the shutter 160, i.e. upon physical contact between the stopping pin 194 and the shutter 160, which prevents the motor 192 to further rotate in the direction wherein the stopping pin 194 is abutted against a respective one of the limit stops 181, 183. In an embodiment, the motor 192 is not prevented from rotating in the opposite direction. In an embodiment, and with reference to FIGS. 8 and 10A, when a physical contact is made between the stopping pin 194 and the first limit stop 181 and the stopping pin 194 is a limit switch, hence the motor 192 no longer drives the shutter 160 in the direction wherein it abuts against the first limit stop 181. In some implementations, this configuration of the shutter 60, i.e. when the shutter 160 is positioned such that the first limit stop 181 contacts the stopping pin 194, is referred to as an initial state or open configuration, as will be described in more detail hereinbelow.

In some implementations, the air intake control assembly 150 can include two or more shutter limit switches, each one being configured to detect a respective configuration of the shutter 160. If the air intake control assembly 150 includes two shutter limit switches, a first one of the shutter limit switches can be configured to detect the open configuration of the shutter 160 as mentioned hereinabove, and a second one of the shutter limit switches can be configured to detect the closed configuration of the shutter 160.

In some implementations, the air intake control assembly 150 can include a pressure gauge mounted to the solid fuel burning appliance 120 to monitor a pressure inside the chimney or a pressure representative of the pressure inside the chimney. The pressure gauge can be a pressure limit switch that monitors/senses the pressure inside the chimney (or in proximity thereof). In other implementations, the weight of the solid fuel can also be monitored, which can contribute to improving the efficiency of the combustion.

The air intake control assembly 150 can also include a potentiometer (not shown), which can be operatively connected to the stepper motor 192 to allow a user to set different combustion modes. In other implementations, the user can set the combustion modes via a thermostat, a mobile application, a remote control and the like. In a non-limitative embodiment, there can be three different combustion modes such as low, medium and high. In this embodiment, for each one of these combustion modes corresponds a combustion mode temperature threshold, i.e. a maximum temperature for a particular combustion mode. The combustion mode temperature threshold for each one of the modes is lower or equal to the maximum temperature threshold of the combustion apparatus. Typically, the combustion mode temperature threshold will increase with a combustion level of the setting. For instance, a medium combustion setting is associated to a combustion mode temperature threshold lower than the maximum temperature threshold of the appliance and lower than the combustion mode temperature threshold of a higher combustion setting. Consequently, when operating in the medium combustion setting, if the temperature sensor monitors a temperature above the combustion mode temperature threshold corresponding to the medium setting and below the maximum temperature threshold of the appliance, the stepper motor 192 rotates the shutter 160 clockwise, from an underneath point of view, to at least partially close at least one of the primary and secondary air intake openings 154*a*, 154*b* and reduce the combustion air entering in the combustion chamber 134 and, simultaneously, the combustion rate in the combustion chamber 134. On the other hand, still when functioning in the exemplified medium setting, if the temperature sensor monitors a temperature below the combustion mode temperature threshold corresponding to the medium setting and thus also below the maximum temperature threshold of the appliance, the stepper motor 192 rotates the shutter 160 counterclockwise, for an underneath point of view, to further open at least one of the primary and secondary air intake openings 154*a*, 154*b*.

According to a fourth aspect, there is provided a method for controlling the air intake into the combustion chamber 134 of the solid fuel burning appliance 120, using the air intake control assembly 150 as described herein.

The method is described with reference to FIGS. 10A-10C depicting various configurations of the air intake control assembly 150 as it goes through the method steps, from the open configuration to the closed configuration.

When igniting a fire, the shutter 160 is in the open configuration, i.e. the most open configuration of the primary and the secondary air intake openings 154*a*, 154*b*. In the embodiment shown in FIG. 10A, in the open configuration, both the primary and the secondary air intake openings 154*a*, 154*b* are fully open, i.e. the shutter 160 is positioned such that the shutter opening 187 substantially matches, or portions thereof are aligned with, the contour of the primary and the secondary air intake openings 154*a*, 154*b* to allow a maximum flow of air to flow through the primary and a secondary combustion air ducts 156*a*, 56*b* and enter the combustion chamber 134. In some implementations, the open configuration corresponds to the initial state, at ambient temperature, of the air intake control assembly 150, for instance prior to a user igniting a fire in the combustion chamber 134. In this initial state, the first limit stop 181 is in physical contact with the stopping pin 194 and this contact prevents the shutter 160 from rotating counterclockwise, from an underneath point of view, any further. In the embodiment wherein the stopping pin 194 is a limit switch, the contact between the first limit stop 181 and the stopping pin 194 prevents the electric current from passing therethrough and reaching the motor 192.

In an embodiment, when configuring the shutter 160 in the open configuration, the stepper motor 192 can perform a few additional steps in the counterclockwise direction, from an underneath point of view, to ensure that the open configuration is properly reached. In another embodiment, when configuring the shutter 160 in the open configuration, the abutment of one of the first limit stop 181 or the second limit stop 183 against the stopping pin 194 triggers a current variation, for example an increase in amperage, which in turn, stops the motor 192 from rotating in the direction wherein it abuts against the first limit stop 183. In yet another embodiment, the shutter 160 can be positioned in the initial state manually. Moreover, in some implementations in which a thermostat is used, the shutter 160 can return to the initial state when a given measured temperature is reached.

It is to be noted that a recalibration of the shutter 160 in the open configuration is not necessarily required after each combustion, but can be done at periodic intervals to "reset" or "recalibrate" the positions of the shutter 160, including the initial state of the shutter 160, i.e. when the first limit stop 181 abuts the stopping pin 194.

When a fire is ignited, the temperature in the vicinity of the combustion chamber 134 monitored by the temperature sensor 188 increases. When the increase is such that the temperature measured by the temperature sensor 188 is above a combustion control temperature threshold, the control of the combustion process in the combustion chamber 134 begins. Typically, when controlling the combustion process in the combustion chamber 134, the stepper motor 192 is actuated to rotate the motor shaft either clockwise or counterclockwise for a number of steps, where each step corresponds to a given number of degrees and the given number of degrees corresponding to the step angle. With the increasing temperature in the combustion chamber 134, the shutter 160 is then positioned in configurations wherein at least one of the primary and secondary air opening 154*a*, 154*b* is further covered by the air opening obstruction portion 172 of the shutter 160 to reduce the combustion air flow entering the combustion chamber 134 and, thus, slower the combustion rate in the combustion chamber 134.

In some implementations, the temperature increase can be such that the shutter 160 rotates clockwise, from an underneath point of view, until the second limit stop 183 abuts the stopping pin 194, i.e. until the shutter 160 is configured in the closed configuration, as shown in FIG. 10C. The closed configuration is also reached when the temperature monitored in vicinity of the combustion chamber 134 reaches or is above a maximum temperature threshold. In some implementations, the maximum temperature threshold can correspond to a temperature limit above which it is not recommended to operate the appliance.

In some implementations, when the temperature monitored by the temperature sensor 188 is between the combustion mode temperature threshold and the maximum temperature threshold, the stepper motor 192 drives the shutter 160 for a number of steps according to the temperature variation in order to further cover or further open at least one of the primary and secondary air intake openings 154*a*, 154*b*.

In some implementations, the adjustments of the angular position of the shutter 160 can occur until a predetermined criterion is met, for instance after a given duration of combustion in the combustion chamber 134, in a predetermined configuration of the shutter 160, such as the open configuration, and the combustion is over. When the predetermined criterion is met, the stepper motor 192 repositions the shutter 160 to its initial state, for instance, wherein the shutter 160 is in the open configuration.

It will be appreciated that the method described herein may be performed in the described order, or in any suitable order.

Figure 11:
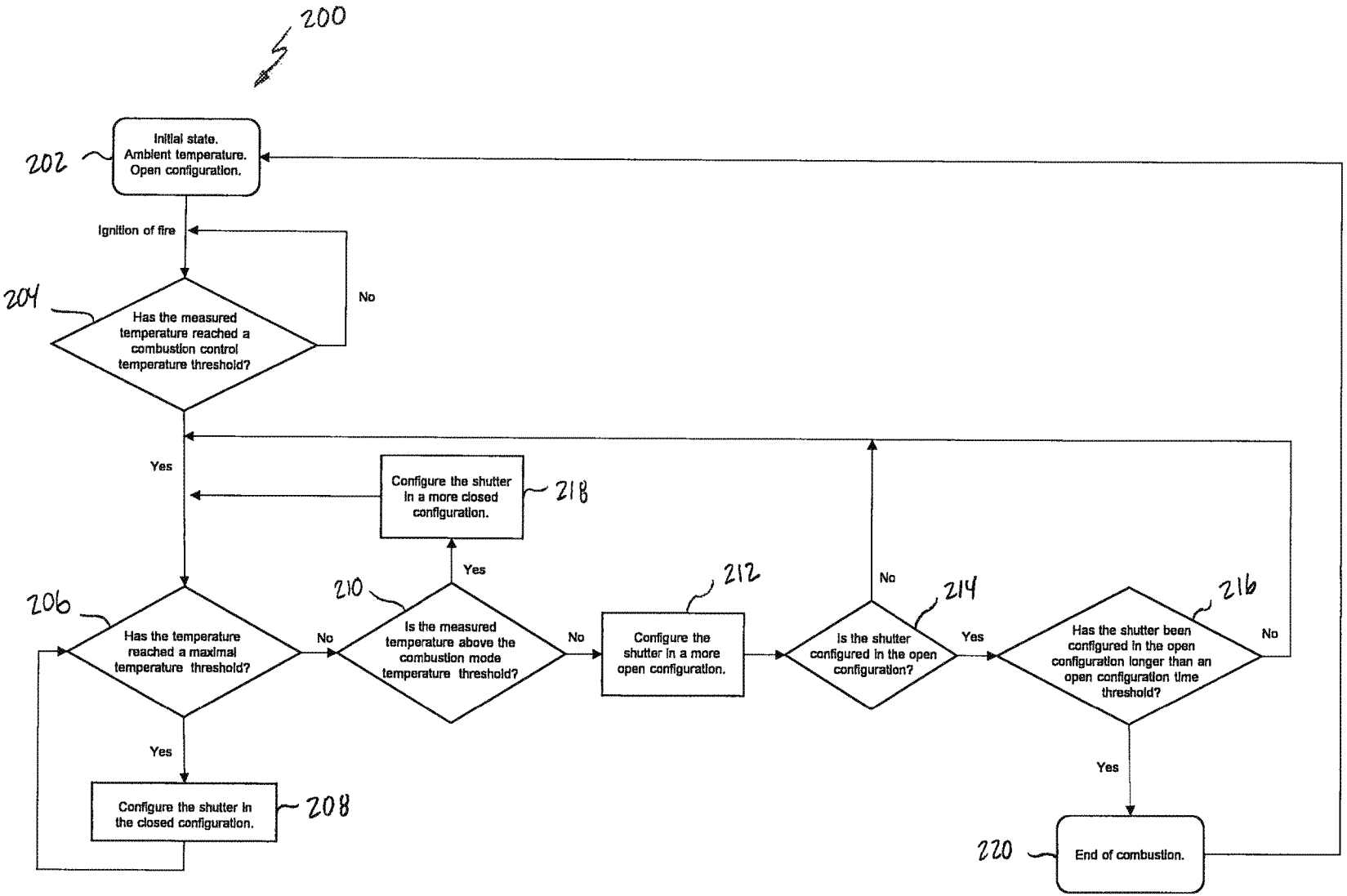
FIG. 11 is a flowchart depicting a method for controlling an air intake into a combustion chamber of a solid fuel burning appliance in accordance with an embodiment.

With reference to FIG. 11, there is shown a flowchart depicting various method steps 200 for controlling an air intake into a combustion chamber 134 of a solid fuel burning appliance 120, according to an embodiment. In the initial state 202, the appliance is at ambient temperature since a fire has not yet been ignited and hence there is no combustion in the combustion chamber 134, and the shutter 160 of the air intake control assembly 150 is positioned in the open configuration.

Then, when a fire is ignited in the combustion chamber 134 of the solid fuel burning appliance 120, the temperature monitored in the proximity of the combustion chamber 134 by the temperature sensor 188 progressively increases. Once the monitored (or measured) temperature reaches a combustion mode temperature threshold 204, the air intake control assembly 150 takes over the control of the air flow entering the combustion chamber 134 to contribute to the regulation of the intensity of the fire depending for instance on the user's settings, the maximal temperature threshold and/or the duration of the combustion in the open configuration. The combustion mode temperature threshold can be for instance determined by the manufacturer of the solid fuel burning appliance 120, and can correspond to a relatively low temperature, i.e. when the combustion of the solid fuel is just starting. As the combustion intensifies, the monitored temperature increases, and is either going to reach the maximal temperature threshold of the appliance 206, which once again can be a value set by the manufacturer, or not reach the maximal temperature threshold. When the maximal temperature threshold is reached, the stepper motor 192 is driven to rotate the shutter 160 of the air intake control assembly 150 to configure the shutter 160 in the closed configuration 208, i.e. with the second limit stop 183 abutting the limit stop 194, to limit the volume of air entering the combustion chamber 134 of the solid fuel burning appliance 120 and thus reduce the combustion intensity.

If the monitored temperature has not yet reached the maximal temperature threshold, the monitored temperature is either below or above the temperature corresponding to a user's setting 210, which can be for instance and without being limitative a low, medium or high setting. If the monitored temperature is below the temperature corresponding to the user's setting, the stepper motor 192 is driven to rotate the shutter 160 of the air intake control assembly 150 for a given number of opening incremental steps correlated to the variation in temperature 212, to increase the opening of at least one of the air intake openings 154*a*, 154*b*, such that a larger volume of air can enter the combustion chamber 134 and the fire can burn at a higher intensity. It is to be noted that if the shutter 160 is already configured in the open configuration 214, this step will not occur, as the first limit stop 181 is abutting the stopping pin 194. Hence, this step occurs if the shutter 160 has previously been rotated towards the closed configuration from the initial state, i.e. from the open configuration. Moreover, in the control loop illustrated on FIG. 11, this step can take place only if the shutter 160 has not been configured in the open configuration longer than an open configuration time threshold 216. It is to be understood by a person skilled in the art that in other implementations, these two steps can be omitted. If the monitored temperature is above the combustion mode temperature threshold corresponding to the user's setting, the stepper motor 192 is driven to rotate the shutter 160 of the air intake control assembly 150 for a number of closing incremental steps 218 to further close the at least one air intake opening 154*a*, 154*b*, such that a smaller volume of air can enter the combustion chamber 134 and the fire can burn at a lower intensity. The number of steps can be a predetermined number of steps or can be correlated with the variations of the measured temperature. If the number of steps is predetermined, it can be a fixed number for all combustion modes (low, medium, high, and the like) or the number of steps can vary in accordance with the combustion mode. For instance and without being limitative, if the number of steps varies in accordance with the combustion mode, the number of steps can higher for lower combustion settings.

In the control loop illustrated in FIG. 11, the regulation of the configuration of the shutter 160 relative to the at least one air intake opening 154*a*, 154*b* occurs until a combustion control end criterion 216 is met, which in the embodiment described above is the time period during which the shutter 160 is configured in the open configuration. When the combustion control end criterion 216 is met, it is expected that the combustion within the combustion chamber 134 is terminated 220. It is to be understood by a person skilled in the art that a different combustion control end criterion other than the duration of the configuration in the open configuration following combustion can be included as part of the control loop, or the criterion can be omitted, as mentioned above.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A solid fuel burning appliance comprising:

an appliance housing having an appliance air inlet defined therein;

a combustion chamber housing at least partially surrounded by the appliance housing and defining a combustion chamber and having at least one combustion chamber air inlet defined therein;

a combustion air path extending between the appliance air inlet and a respective one of the at least one combustion chamber air inlet and providing fluid communication inbetween;

an air intake control assembly comprising:

a mounting structure mounted to at least one of the appliance housing and the combustion chamber housing and having at least one air intake opening extending in the combustion air path;

a shutter mounted to the mounting structure and configurable between an open configuration and a closed configuration in which the shutter at least partially covers the at least one air intake opening;

a power supply;

a motor operatively connected to the shutter and activable to modify a configuration of the shutter with respect to the at least one air intake opening and thereby modify a covering of the at least one air intake opening by the shutter;

a temperature limit switch electrically connected to the motor and monitoring a temperature representative of a temperature of the combustion chamber and being configurable in a closed configuration allowing electric current passage therethrough and an open configuration preventing electric current passage therethrough;

a shutter limit switch configured to sense at least one configuration of the shutter, the shutter limit switch being positioned to physically contact the shutter when the shutter is in the open configuration, the shutter limit switch being configurable in an open configuration upon physical contact between the shutter limit switch and the shutter and preventing electric current therethrough and to reach the motor, and in a closed configuration upon absence of physical contact between the shutter limit switch and the shutter allowing electric current passage therethrough; and an electric circuit connecting the motor to the power supply through the temperature limit switch wherein the electric circuit is in an open configuration when at least one of the shutter and the temperature limit switch is in the open configuration to prevent electric current to reach the motor.

2. The solid fuel burning appliance of claim 1, wherein the temperature limit switch is in the open configuration if the monitored temperature is below a combustion control temperature threshold and is in the closed configuration otherwise.

3. The solid fuel burning appliance of claim 1, wherein the shutter comprises a primary pivotable arm and a secondary pivotable arm and the primary pivotable arm is pivotable between a first open configuration and a first closed configuration and the secondary pivotable arm is pivotable between a second open configuration and a second closed configuration, wherein the shutter limit switch senses at least one configuration of the primary pivotable arm and the at least one configuration comprises the first open configuration and the motor is operatively connected to the secondary pivotable arm and configures same into the second closed configuration upon actuation thereof and wherein the primary pivotable arm and the secondary pivotable arm are cooperatively engaged with each other through an interconnecting flange and configuration of the primary pivotable arm into the first open configuration configures the secondary pivotable arm into the second open configuration.

4. The solid fuel burning appliance of claim 3, wherein the shutter limit switch comprises a primary shutter limit switch and a secondary shutter limit switch, the primary shutter limit switch being positioned to physically contact the primary pivoting arm when the primary pivoting arm is in the open configuration and the secondary shutter limit switch being positioned to physically contact the secondary pivoting arm when the secondary pivoting arm is in the closed configuration and wherein the primary shutter limit switch and the secondary shutter limit switch are mounted in series, both the primary shutter limit switch and the secondary shutter limit switch being required to be in the closed configuration to allow electric current to pass therethrough.

5. The solid fuel burning appliance of claim 1, further comprising a chimney in gas communication with the combustion chamber and the air intake control assembly further comprises a pressure limit switch monitoring a pressure representative of a pressure inside the chimney, the pressure limit switch electrically connecting the motor to the power supply through the electric circuit, the pressure limit switch being configurable in a closed configuration allowing electric current passage therethrough and an open configuration preventing electric current passage therethrough, the pressure limit switch being configurable in the closed configuration when the pressure monitored in the chimney is equal to or above a pressure threshold.

6. The solid fuel burning appliance of claim 1, wherein air can flow through the at least one air intake opening in the closed configuration.

7. An air intake control assembly for adjusting an air intake into a combustion chamber of a solid fuel burning appliance having an appliance air inlet, the air intake control assembly comprising:

a mounting structure having at least one air intake opening extending in a combustion air path defined between the appliance air inlet and the combustion chamber;

a shutter mounted to the mounting structure and configurable between an open configuration and a closed configuration in which the shutter at least partially covers the at least one air intake opening, the shutter comprising a primary pivotable arm and a secondary pivotable arm, the primary pivotable arm being pivotable between a first open configuration and a first closed configuration and the secondary pivotable arm being pivotable between a second open configuration and a second closed configuration;

a power supply;

a motor operatively connected to the shutter and activable to modify a configuration of the shutter with respect to the at least one air intake opening and thereby modify a covering of the at least one air intake opening by the shutter;

a temperature sensor operatively connected to the motor and monitoring a temperature representative of a temperature of the combustion chamber; and an electric circuit electrically connecting the motor, the power supply and the shutter and being operatively connected the temperature sensor, wherein the electric circuit is in an open configuration when at least one of the shutter is in the open configuration and the temperature monitored by the temperature sensor is below a combustion control temperature threshold to prevent electric current to reach the motor.

8. The air intake control assembly of claim 7, wherein the temperature sensor comprises a temperature limit switch configurable in a closed configuration allowing electric current passage therethrough and an open configuration preventing electric current passage therethrough, the temperature limit switch being configured in the closed configuration when the temperature monitored by the temperature sensor is equal to or above the combustion control temperature threshold.

9. The air intake control assembly of claim 8, wherein the electric circuit connects the motor to the power supply through the temperature limit switch and the intake control assembly further comprises a shutter limit switch configured to sense at least one configuration of the shutter and electrically connecting the motor to the power supply through the electric circuit, the shutter limit switch being configurable in an open configuration upon sensing of the shutter configured in the at least one configuration and preventing electric current therethrough and to reach the motor, and being configurable in a closed configuration otherwise allowing electric current passage therethrough.

10. The air intake control assembly of claim 9, wherein the shutter limit switch is positioned to physically contact the shutter when the shutter is in the open configuration and the shutter limit switch being configurable in the open configuration upon physical contact between the shutter limit switch and the shutter and preventing electric current therethrough and to reach the motor, and being configurable in the closed configuration upon absence of physical contact between the shutter limit switch and the shutter allowing electric current passage therethrough.

11. The air intake control assembly of claim 9, wherein the shutter limit switch senses at least one configuration of the primary pivotable arm and the at least one configuration comprises the first open configuration and the motor is operatively connected to the secondary pivotable arm and configures same into the second at closed configuration upon actuation thereof.

12. The air intake control assembly of claim 11, wherein the primary pivotable arm and the secondary pivotable arm are cooperatively engaged with each other through an interconnecting flange and configuration of the primary pivotable arm into the first open configuration configures the secondary pivotable arm into the second open configuration and wherein at least one of the primary pivotable arm and the secondary pivotable arm comprises a pivotable arm opening defined therein and an auxiliary shutter superposed thereto with an auxiliary air intake opening defined therein, wherein the auxiliary shutter is configurable in an open configuration wherein the pivotable arm opening and the auxiliary air intake opening are in register, and in an at least partially closed configuration otherwise.

13. The air intake control assembly of claim 11, wherein the shutter limit switch comprises a primary shutter limit switch and a secondary shutter limit switch, the primary shutter limit switch being positioned to physically contact the primary pivoting arm when the primary pivoting arm is in the open configuration and the secondary shutter limit switch being positioned to physically contact the secondary pivoting arm when the secondary pivoting arm is in the closed configuration, and wherein the primary shutter limit switch and the secondary shutter limit switch are mounted in series, both the primary shutter limit switch and the secondary shutter limit switch being required to be in the closed configuration to allow electric current to pass therethrough.

14. The air intake control assembly of claim 7, further comprising a pressure limit switch monitoring a pressure representative of a pressure inside a chimney of the solid fuel burning appliance, the pressure limit switch electrically connecting the motor to the power supply through the electric circuit, the pressure limit switch being configurable in a closed configuration allowing electric current passage therethrough and an open configuration preventing electric current passage therethrough, the pressure limit switch being configurable in the closed configuration when the pressure monitored in the chimney is equal to or above a pressure threshold.

15. The air intake control assembly of claim 7, wherein air can flow through the at least one air intake opening in the closed configuration.

16. A solid fuel burning appliance comprising:

an appliance housing having the appliance air inlet defined therein;

a combustion chamber housing at least partially surrounded by the appliance housing and defining the combustion chamber and having a combustion chamber air inlet defined therein;

the combustion air path extending between the appliance air inlet and the combustion chamber air inlet and providing fluid communication inbetween; and the air intake control assembly as claimed in claim 7.

17. A method for controlling an air intake into a combustion chamber of a solid fuel burning appliance using an air intake control assembly having a shutter configurable with respect to a primary air intake opening extending in a primary combustion air path defined between an appliance air inlet and a primary combustion chamber air inlet and a secondary air intake opening extending in a second combustion air path defined between the appliance air inlet and a second combustion chamber air inlet, the method comprising:

sensing a configuration of the shutter with respect to at least one of the primary and secondary air intake openings;

monitoring a temperature representative of a temperature of the combustion chamber;

comparing the monitored temperature to a combustion control temperature threshold; and if the monitored temperature is equal to or above the temperature threshold and the sensed configuration of the shutter is in at least one predetermined configuration, further closing the primary and secondary air intake openings by displacing the shutter with respect to the primary and secondary air intake openings while still allowing air through the primary and secondary air intake openings.

18. The method of claim 17, further comprising configuring the shutter in an open configuration and igniting a fire in the combustion chamber and wherein the at least one predetermined configuration of the shutter comprises a non-open configuration.

19. The method of claim 17, wherein the at least one predetermined configuration is a configuration wherein the configuration of the shutter is not sensed.

20. The method of claim 17, wherein further closing the primary and secondary air intake openings by displacing the shutter with respect to the primary and secondary air intake openings comprises:

closing the primary and the secondary air intake openings by displacing the shutter by at least one closing incremental step with respect to the primary and the secondary air intake openings; and if the monitored temperature is below the temperature threshold, opening the primary and the secondary air intake openings by displacing the shutter by at least one opening incremental step with respect to the primary and the secondary air intake openings.

21. The method of claim 20, wherein sensing the configuration of the shutter with respect to the at least one of the primary and secondary air intake openings further comprises preventing displacement of the shutter by the at least one incremental opening step if the shutter is in an open configuration and by the at least one incremental closing step if the shutter is in a closed configuration.

22. The method of claim 17, further comprising preventing displacement of the shutter by the at least one incremental opening step if the monitored temperature is below the combustion control temperature threshold.

23. The method of claim 17, further comprising comparing the monitored temperature to a maximal temperature threshold and configuring the shutter in a closed configuration if the monitored temperature is equal to or above the maximal temperature threshold.

24. The method of claim 17, wherein monitoring the temperature representative of the temperature of the combustion chamber comprises using a temperature sensor provided inside the combustion chamber or in contact with a wall of the combustion chamber.

* * * * *